US008215525B2

(12) United States Patent
Rassias

(10) Patent No.: US 8,215,525 B2
(45) **Date of Patent: *Jul. 10, 2012**

(54) LOCKABLE HOLSTER WITH MULTI-DIRECTIONALLY ADJUSTABLE HIP MOUNT

(76) Inventor: John N. Rassias, Boca Raton, FL (US)

( * ) Notice: Subject to any disclaimer, the term of this patent is extended or adjusted under 35 U.S.C. 154(b) by 962 days.

This patent is subject to a terminal disclaimer.

(21) Appl. No.: 12/160,489

(22) PCT Filed: Feb. 7, 2007

(86) PCT No.: PCT/US2007/003327

§ 371 (c)(1),
(2), (4) Date: Jul. 25, 2008

(87) PCT Pub. No.: WO2008/018915

PCT Pub. Date: Feb. 14, 2008

(65) Prior Publication Data

US 2009/0001117 A1 Jan. 1, 2009

Related U.S. Application Data

(60) Provisional application No. 60/765,992, filed on Feb. 7, 2006.

(51) Int. Cl.
*F41C 33/00* (2006.01)
*F41C 33/02* (2006.01)

(52) U.S. Cl. ..... 224/245; 224/192; 224/912

(58) Field of Classification Search ..... 224/192–193, 224/243, 245, 911, 912

See application file for complete search history.

(56) References Cited

U.S. PATENT DOCUMENTS

| | | | | |
|---|---|---|---|---|
| 1,148,935 | A * | 8/1915 | Snavely | 224/243 |
| 3,269,620 | A | 8/1966 | DuBois | |
| 3,550,822 | A | 12/1970 | Lloyd | |
| 3,718,240 | A | 2/1973 | Rose | |
| 3,744,687 | A | 7/1973 | Oreck | |
| 4,055,015 | A | 10/1977 | Musgrave | |
| 4,325,505 | A | 4/1982 | Hillman | |
| 4,689,908 | A | 9/1987 | McClellan | |
| 4,694,980 | A * | 9/1987 | Rogers | 224/243 |
| 4,858,799 | A | 8/1989 | Young | |
| 4,901,987 | A | 2/1990 | Greenhill et al. | |
| 4,912,867 | A | 4/1990 | Dukes, Jr. | |

(Continued)

FOREIGN PATENT DOCUMENTS

| | | |
|---|---|---|
| CA | 2536597 | 3/2005 |

(Continued)

*Primary Examiner* — Justin Larson
*Assistant Examiner* — Adam Waggenspack
(74) *Attorney, Agent, or Firm* — The Webb Law Firm, PC

(57) ABSTRACT

A lockable holster includes a shroud having an elongated opening to receive a handgun with the grip of the handgun outside the shroud. A biasing member at the first end of the shroud applies a biasing force on the firing end of the handgun to bias opposite end of the handgun into engagement with the locking arrangement at the opposite second end of the shroud to secure the handgun in the shroud. In another non-limiting embodiment of the invention, the holster is mounted on a plate having fasteners passing through elongated slits into the top of the shroud to angle the shroud relative to the plate, and the plate is mounted for vertical adjustment on a U-shaped securing clamp. The holster further includes mechanical arrangements which prevent unauthorized removal of the handgun from the shroud, prevents firing the handgun when in the shroud, and signals a loaded handgun in the shroud.

16 Claims, 25 Drawing Sheets

U.S. PATENT DOCUMENTS

| | | | | |
|---|---|---|---|---|
| 5,094,376 | A | 3/1992 | Baruch | |
| 5,099,596 | A | 3/1992 | Butler, Jr. | |
| 5,215,238 | A * | 6/1993 | Baruch | 224/243 |
| 5,419,069 | A | 5/1995 | Mumbleau et al. | |
| 5,446,988 | A | 9/1995 | Frederick, Jr. | |
| 5,448,927 | A | 9/1995 | Lumpkin | |
| 5,467,909 | A | 11/1995 | Resca et al. | |
| 5,611,164 | A | 3/1997 | Rassias | |
| 5,768,816 | A | 6/1998 | Rassias | |
| 5,875,944 | A | 3/1999 | Beletsky | |
| 6,149,042 | A | 11/2000 | Rassias | |
| 6,267,279 | B1 | 7/2001 | Matthews | |
| 6,415,541 | B1 | 7/2002 | Rassias | |
| 6,585,209 | B1 * | 7/2003 | Mattingly | 248/309.1 |
| 6,691,906 | B2 | 2/2004 | Cragg | |
| 6,732,891 | B2 * | 5/2004 | Locklear, III | 224/244 |
| 6,755,331 | B2 | 6/2004 | Rassias | |
| 7,950,553 | B2 * | 5/2011 | Rassias | 224/243 |
| 2001/0048009 | A1 * | 12/2001 | Vor Keller et al. | 224/244 |
| 2003/0205594 | A1 | 11/2003 | Rassias | |
| 2005/0224537 | A1 * | 10/2005 | Rassias | 224/243 |
| 2007/0108242 | A1 | 5/2007 | Rassias | |

FOREIGN PATENT DOCUMENTS

| | | |
|---|---|---|
| DE | 19952640 | 6/2000 |
| DE | 10154226 | 5/2003 |
| WO | 9745691 | 12/1997 |
| WO | 0151876 | 7/2001 |
| WO | 2004071231 | 8/2004 |
| WO | 2005033610 | 4/2005 |
| WO | 2006121965 | 11/2006 |

* cited by examiner

Fig. 1
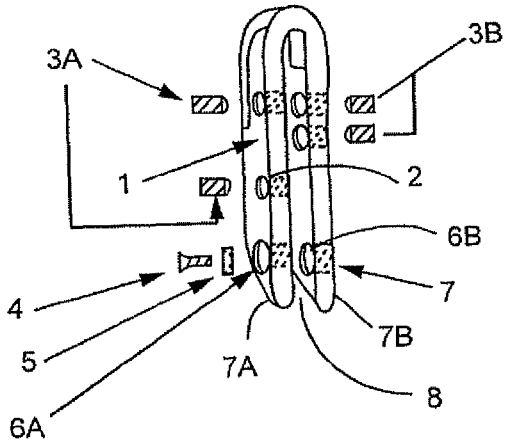
Fig. 2
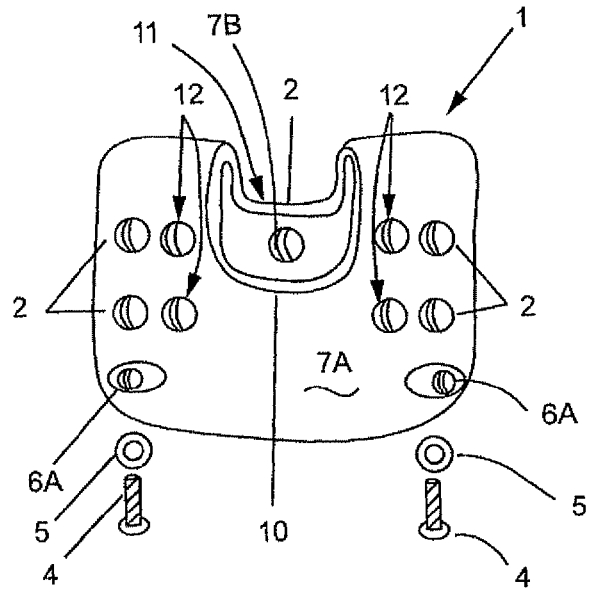
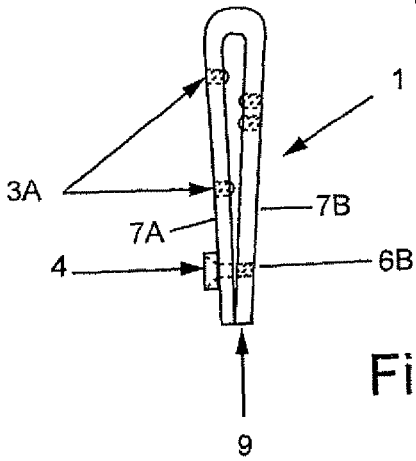
Fig. 3

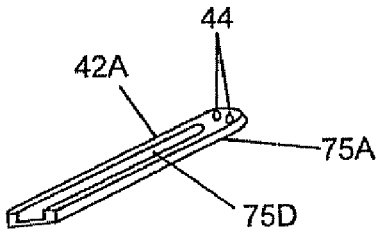
Fig. 18
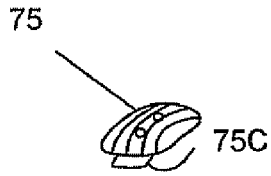
Fig. 18A
Fig. 18B
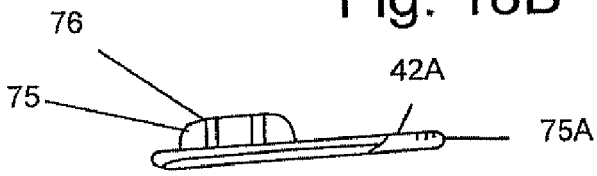
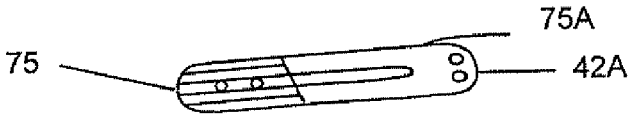
Fig. 18C
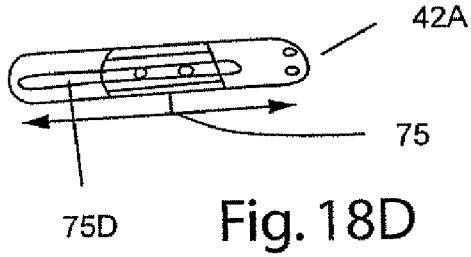
Fig. 18D
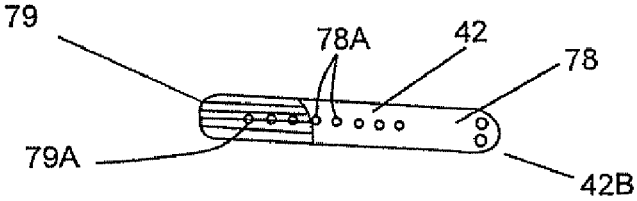
Fig. 19A
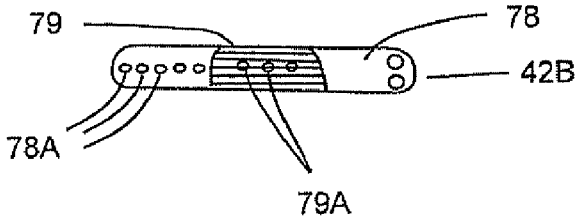
Fig. 19B

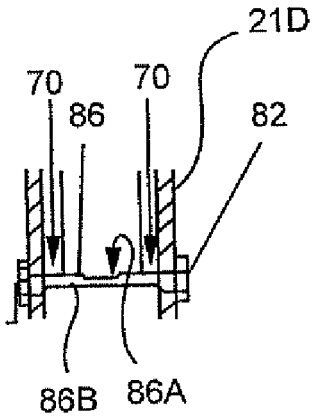
Fig. 22A
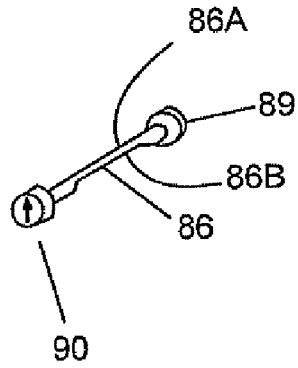
Fig. 22B
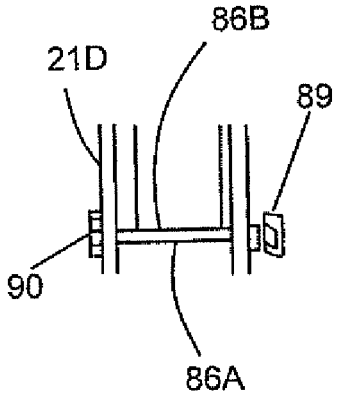
Fig. 23A
Fig. 23B
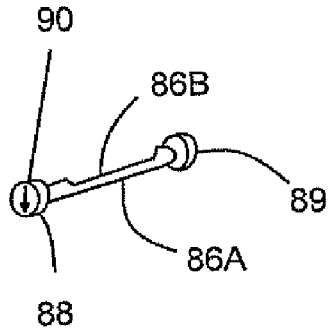
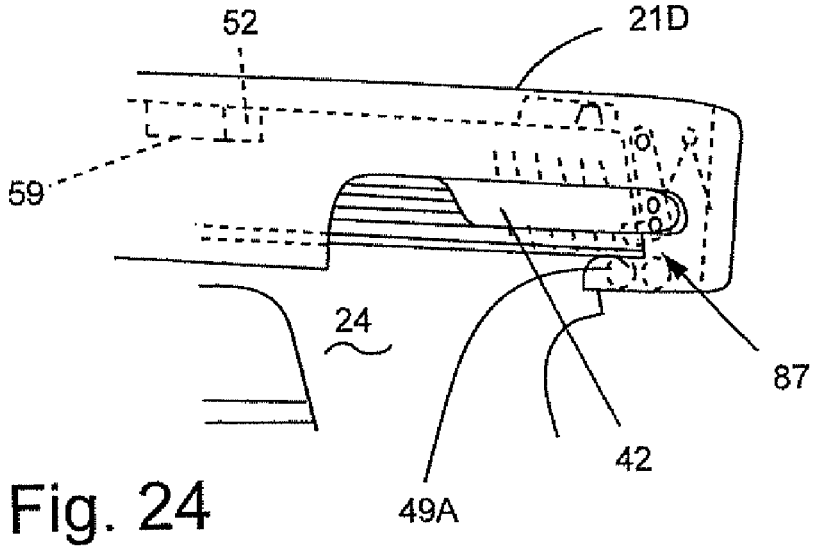
Fig. 24

LOCKABLE HOLSTER WITH MULTI-DIRECTIONALLY ADJUSTABLE HIP MOUNT

CROSS-REFERENCE TO RELATED APPLICATIONS

This application claims the benefit of the filing date of U.S. Provisional Patent Application Ser. No. 60/765,992 filed on Feb. 7, 2006, and the disclosure of Provisional Patent Application Ser. No. 60/765,992 is hereby incorporated by reference.

BACKGROUND OF THE INVENTION

1. Field of the Invention

This invention relates to a lockable holster and in one non-limiting embodiment of the invention to a lockable holster with multi-directionally adjustable hip mount.

2. Discussion of the Technical Problem

Law enforcement agencies worldwide report a surging increase in violence against their police officers in the performance of their duties. Contemporaneously, over seventy percent of the new recruits of law enforcement agencies have no experience with the use of firearms. Budgetary restraints have compounded the problem by reducing the initial and continuing training required for safe and proficient use of a firearm should a situation arise. Proper safety against gun-grab attempts, as well as off duty safety of the firearm, have been seconded to the needed proficiency in computer use, massive detailed reports and court appearances.

As can be appreciated by those skilled in the art, it would be advantageous to provide a holster that provides the officer with improved protection against gun-grab attempts and unauthorized use of his firearm on duty, as well as off duty, while requiring a very short period of time to efficiently train new recruits, as well as seasoned officers, in the effective use of the holster. More particularly, it is desired to provide a holster design and function that is based on gross motor memory, e.g. when a weapon, e.g. a handgun such as a pistol or revolver is placed into the holster, the weapon is automatically locked in an inoperative condition, and the trigger is non-functional until in one simple motion the holster's safety lever is released and the weapon is drawn ready to fire.

Presently available holsters which rely on straps, snaps, tensioning screws and hoods, which have to be sequentially overcome in a complex motor memory sequence by the manipulation of various fingers of the drawing hand, can deteriorate the proper grip on the pistol. It is desired to provide a new holster which allows a much faster and safer draw, with a perfect grip, in one gross motor memory movement. There are available holsters, e.g. as disclosed in U.S. Pat. Nos. 6,755,331, 6,415,541, 6,149,042, 5,768,816 and WO01/051876A (hereinafter also referred to as "Type A holster") which provide for the pistol to be removed from the rear and down as opposed to less desirable holsters which require the pistol to be removed in an upward motion. Re-holstering into the Type A holster automatically locks the pistol with the added safety of having the pistol mechanically incapable of firing until the pistol is withdrawn by releasing the Type A holster's safety lever simultaneously upon withdrawing the pistol.

SUMMARY OF THE INVENTION

The improved holster of the invention includes, among other things, various retention arrangements as officer's options in close quarter public areas. The pistol can be key-locked into the holster for storage, rendering it unfireable and protected from unauthorized use. Additionally, both pistols and revolvers with mounted weapon lights and/or laser attachments can be placed into the holster of the invention without requiring removal of those attachments prior to re-holstering. This is accomplished without bulking out the holster, and the holster has the added advantage of attaching or removing the weapon's optics without drawing the pistol.

In one non-limiting embodiment of the invention, the holster for a handgun includes a shroud having a first end and an opposite second end, a wall between the first and second ends to provide the shroud with a cavity, the wall having a first edge and a second edge spaced from the first edge to provide an elongated opening between the first and second ends, the opening providing access to the cavity to receive a portion of the handgun with an end portion of the grip of the handgun outside the opening. A biasing member is positioned in the cavity at the first end of the shroud. The biasing member, when compressed, applies a bias force toward the second end of the shroud. A locking arrangement is positioned in the cavity at the second end of the shroud. With the handgun in the cavity, the biasing member applies a biasing force on the firing end of the handgun to bias the opposite end of the handgun into engagement with the locking arrangement to secure the handgun in the shroud. Other features of the holster of the invention include, but are not limited to the following.

A loaded chamber indicator allowing the person carrying the holster of the invention immediate confirmation that the pistol is loaded. In one non-limiting embodiment of the invention, this is accomplished by sliding a finger in a short movement over a small section of the shroud front. When a round is chambered, a protrusion is felt. If the chamber is empty, the surface is smooth. As is appreciated by those skilled in the art, there have been many tragedies where an officer has placed a loaded magazine into the pistol and inadvertently forgot to retract the slide to chamber a round to place the pistol into battery. Upon subsequent drawing and upon pulling the trigger, the firing pin would strike into an empty chamber, requiring a two hand maneuver to load the pistol in the midst of a crisis.

Currently designed holsters have extremely limited adjustability relative to the size and shape of the person using the holster. More particularly, and not limited thereto, women who enter law enforcement, corrections and the military cannot comfortably wear and/or effectively use a man's holster because, but not limited to, the waist to hip ratios are significantly different. The holster of the invention overcomes this problem by providing, among other things, rapid omni-directional adjustability allowing personal preference in the holster's height, tilt in or out, tilt backward and forward, butt close to body or away so as to accommodate body armor, and/or straight up or down in any combination.

The holster of the invention provides access to the pistol in the holster while standing or seated in a car without telegraphing to the possible opponent that the pistol is being drawn. Further, the draw is faster, more discrete, and safer.

The holster of the invention is designed on a modular basis in that the shroud can be mounted for duty carry, concealed carry and under the shoulder carry, and mounted to a dashboard, inside a closet and under a desk utilizing accessories of the invention. The slide shroud can also be mounted to any of the accessories of the invention eliminating need to purchase a new complete holster.

The holster of the invention also makes it possible for carriers of weapons to have the weapon mounted lasers and lights without requiring the attachment of the optics after drawing the weapon from the holster and/or removing them before holstering the weapon. Then holster of the invention automatically locks the weapon into the holster, locks the trigger from actioning and, at the same time, prevents the cylinder of the weapon from revolving into a fireable status even if the trigger is forcefully pulled. These advantages are now available for both hammer and hammerless weapons. In one non-limiting embodiment of the invention, the holsters are key-lockable for safe storage and tactically lockable while carrying the weapon by inserting a tactical pin in the same hole as used for the storage lock. In another non-limiting embodiment of the invention, the holsters are made of a material that is extremely durable and impervious to heat, cold and solvents, e.g., high-strength aluminum, ZYTEL, DENDRIL, or other similar high-strength plastic composite.

The holster of the invention includes, among other things, a slide locking cam lug design that is totally free of any torque when depressing the holster's safety lever. More particularly, the tactical or storage locking pin no longer bears on the slide locking cam lug as the lug blocks the pistol's removal by bearing on the bottom of the slide itself.

The holster provides new optional additional levels of retention, which includes, among other things, a lateral slide interface locking rod (in either a sliding or rotating choice) which prevents the pistol's removal as the bottom of the slide must clear the rod's indents to remove the pistol from the holster; and/or includes a new position for the tactical pin under the slide itself or through the trigger shield mounted to the slide shroud which also shields the magazine release button on the receiver.

A safety release lever incorporating features of the invention is located directly above the person's thumb. Many persons, e.g. law enforcement, have that position ingrained in their mind as a majority of the pistols they use have the pistol's safety and/or decocker in that position. The holsters of the invention do not preclude or interrupt any of the pistol's operating safety functions but takes into consideration the vast difference in the size of people's hands and fingers. Consequently, the holster of the invention incorporates variable adjustment methods on the thumb contact portion of the safety release lever to accommodate different thumbs of male and female officers relative to their grasp of hand to thumb ratio on the pistol's grip. Accordingly, now an officer can customize their drawing by micro-adjusting the safety release lever with a tool, e.g., a small Allen wrench. The ability to adjust to one's preference accelerates proper training at the range and performance on duty.

The design of the holsters of the invention allows immediate and discreet access to a pistol. The pistol is removed by a motion of ¼ inch (0.64 centimeter "cm.") as opposed to the 3 to 6 inch (7.64 to 15.28 cm.) distance required in the prior art. Thus, telegraphing action by the officer under the circumstances of confrontation is eliminated. Further, the invention relates to a method of locking a handgun in a holster.

BRIEF DESCRIPTION OF THE DRAWINGS

FIG. 1 is a perspective end view of a non-limiting embodiment of a hip plate mount of the invention.

FIG. 2 is an elevated front view of the hip plate mount shown in FIG. 1.

FIG. 3 is an elevated end view of the hip mount plate shown in FIG. 2.

FIG. 18 includes FIGS. 18A-18D, which are various views of another non-limiting embodiment of the safety lever of the invention.

FIG. 19 includes FIGS. 19A and 19B, which are various views of still another non-limiting embodiment of the safety lever of the invention.

FIG. 22A is a view similar to the view of FIG. 21A showing, and FIG. 22B is a perspective view of, another non-limiting embodiment of a pin moveable from an un-lock position to a lock position (FIG. 22A).

FIGS. 23A and 23B are views similar to the views of FIGS. 22A and 22B, respectively showing the pin in the release position.

FIG. 24 is a view similar to the view of FIG. 15B.

DESCRIPTION OF THE PREFERRED EMBODIMENTS

Figure 4:
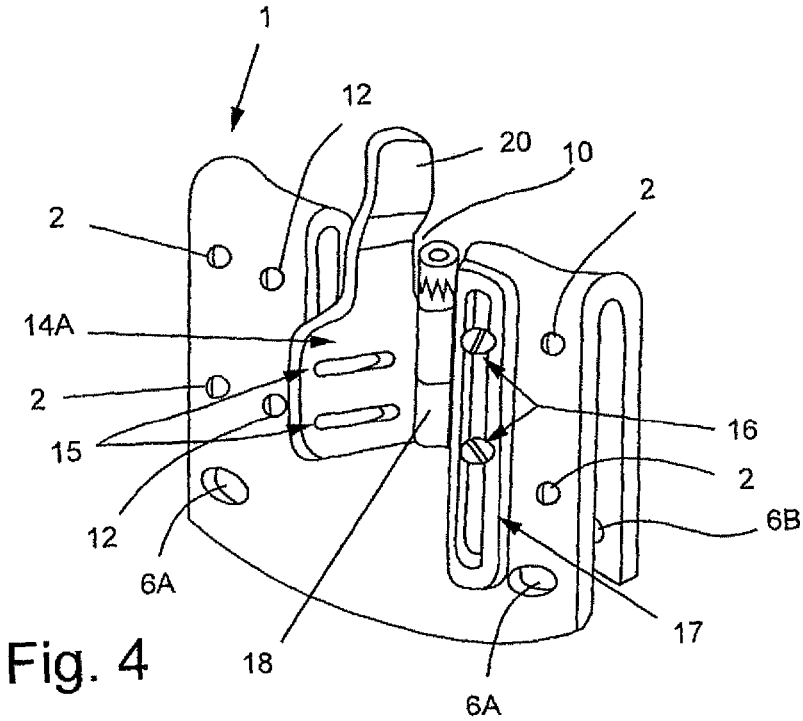
FIG. 4 is an elevated front end view of another non-limiting embodiment of the hip plate mount of the invention.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10. Also, as used herein, the terms "deposited over", "applied over", or "provided over" mean deposited, applied, or provided on but not necessarily in surface contact with. For example, a material "deposited over" a substrate does not preclude the presence of one or more other materials of the same or different composition located between the deposited material and the substrate.

Before discussing several non-limiting embodiments of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, unless indicated otherwise, in the following discussion, like numbers refer to like elements.

With reference to FIGS. 1-3 as needed there is shown a multidirectional adjustable hip plate mount 1 of the invention. The hip plate mount 1 has a generally inverted U-shape. In the following discussion of the invention, the hip plate mount 1 is mounted on a belt 35 (see FIG. 10), however, the invention is not limited thereto, and the hip mount plate 1 can be mounted on a plate secured to a table or dashboard of a car (not shown). The hip plate mount 1 has holes 2 to receive front belt compression screws 3A, rear belt compression screws 3B, front hip compression screws 4 and washers 5. In one non-limiting embodiment of the invention, the inverted U-shape hip plate mount 1 has an opening 8 to receive the belt 35 and the front hip compression screw 4 passes through washer 5 and hole 6A in front leg member 7A of the hip plate mount 1 into threaded rear hole 6B to compress the hip mount 1, as shown in FIG. 3, to capture the hip plate mount 1 on the belt. Thereafter, the front belt compression screws 3A and the rear belt compression screws 3B are screwed into the front leg member 7A and the back leg member 7B of the U-shaped hip plate mount 1 in any convenient manner, e.g. by hex wrench, to secure the hip plate mount 1 in a desired orientation to the belt. Although not limiting to the invention as shown in FIG. 2, the hip plate mount 1 is provided with a cut-away 10 at the center of the front leg member 7 of the hip plate mount 1 and cut-away 11 at the center of the back leg member 7B of the hip plate mount 1 for ease of fitting the hip plate mount 1 to the contour of the belt 35. In one non-limiting embodiment of the invention, the front leg member 7A of the hip plate mount 1 is provided with threaded inserts or holes 12 (clearly shown in FIG. 2) on each side of the cut away 10 in the front leg member 7A for mounting the adjustable hip plate bracket 14 A, 14B to the hip plate mount 1 on one side of the cut away 10 (see FIGS. 4 and 5) in a manner discussed below.

As can be appreciated in the instance when the hip plate mount 1 is made of a soft material, e.g. leather, the holes of the hip plate mount 1 designated to receive threaded screws preferably have inserts of a hardened material, e.g., but not limiting to the invention, metal or plastic.

Figure 4A:
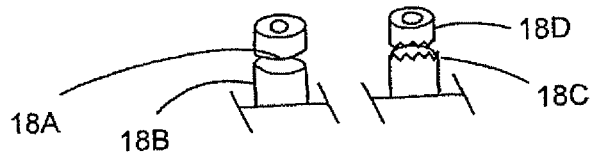
FIG. 4A is an isolation view of a hinge.
Figure 5:
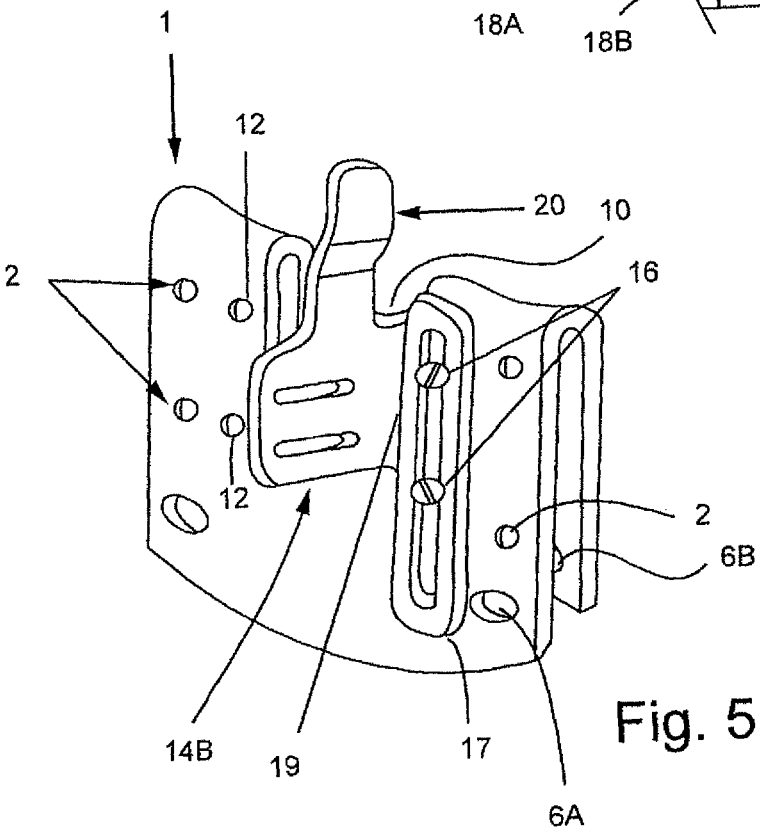
FIG. 5. is view similar to the view of FIG. 4 of still another non-limiting embodiment the hip plate mount of the invention.

With reference to FIG. 4, the plates 14A, 14B for securing a holster for a handgun, e.g. pistol or revolver (discussed in detail below), are secured to the hip plate mount 1 by adjustable hip plate mount face plate 17 secured to the hip plate mount 1 by screws 16. In FIG. 4, the plate 14A is mounted to the face plate 17 by an adjustable connecting hinge 18 and, in FIG. 5, by a fixed connection 19. The plates 14A, 14B are provided with a front access shield 20 for protecting the safety lever 42 of spring-loaded pivoting cam lock 43 of the holster (see FIG. 22) discussed in detail below. With reference to FIG. 4A, contacting surface portions 18A of hinge 18B can be smooth or have teeth 18C as shown for hinge 18D in FIG. 4A.

Figure 6:
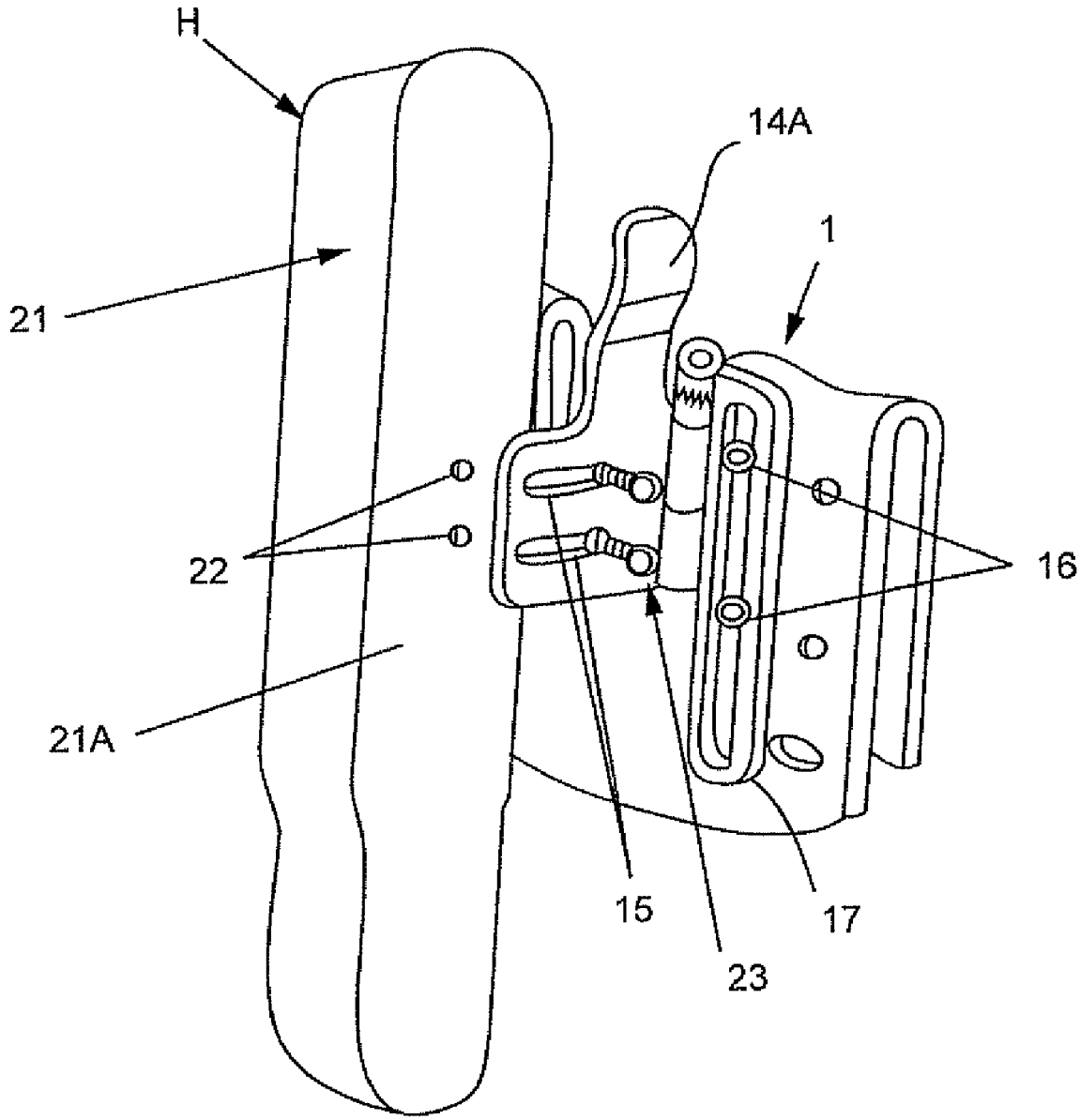
FIG. 6 is an elevated front end view of the hip plate mount shown in FIG. 4 having a non-limiting embodiment of a holster of the invention mounted thereon.
Figure 7:
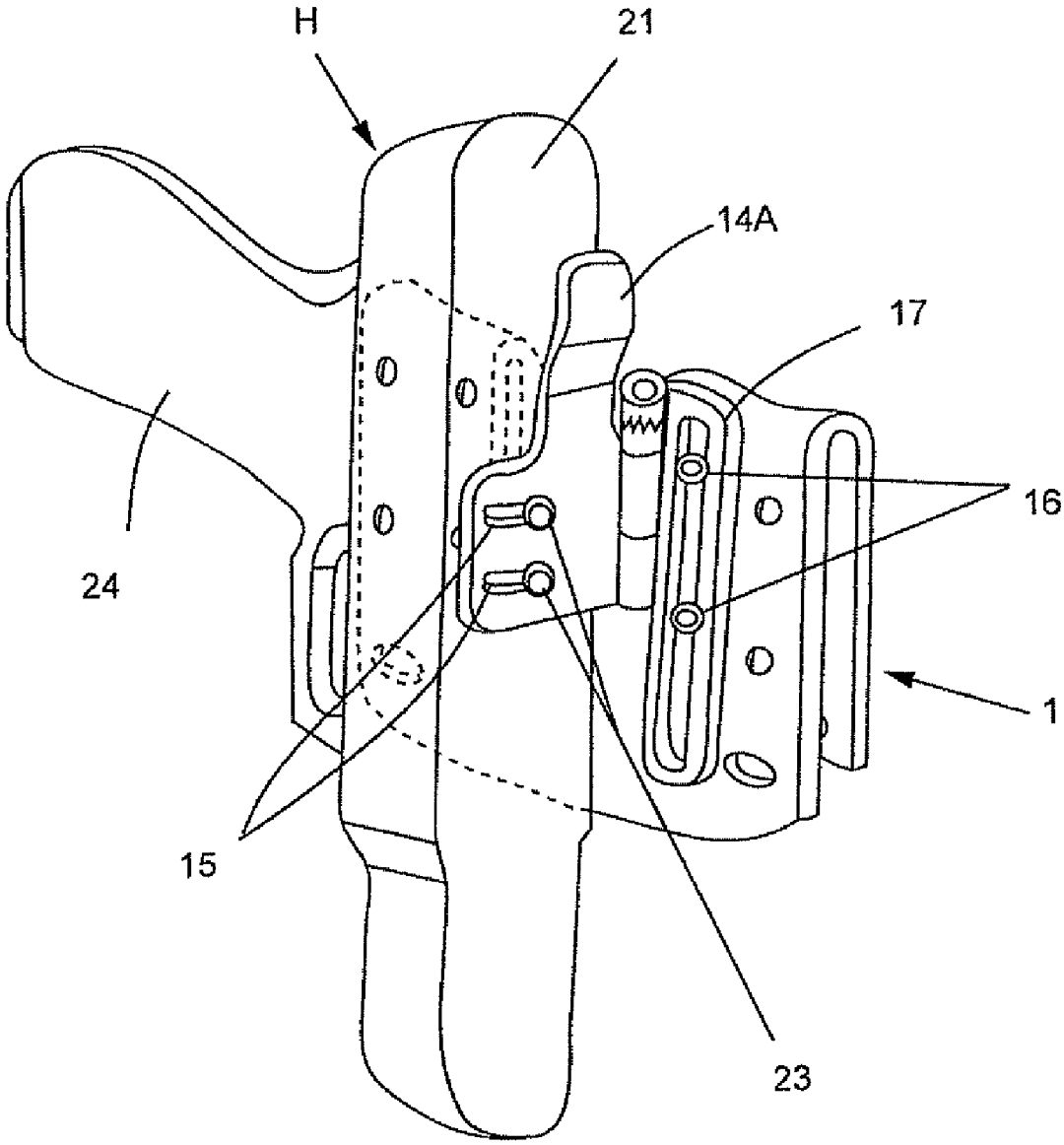
FIG. 7 is a view similar to the view of FIG. 6 showing a pistol mounted in the holster in accordance to the invention.
Figure 8:
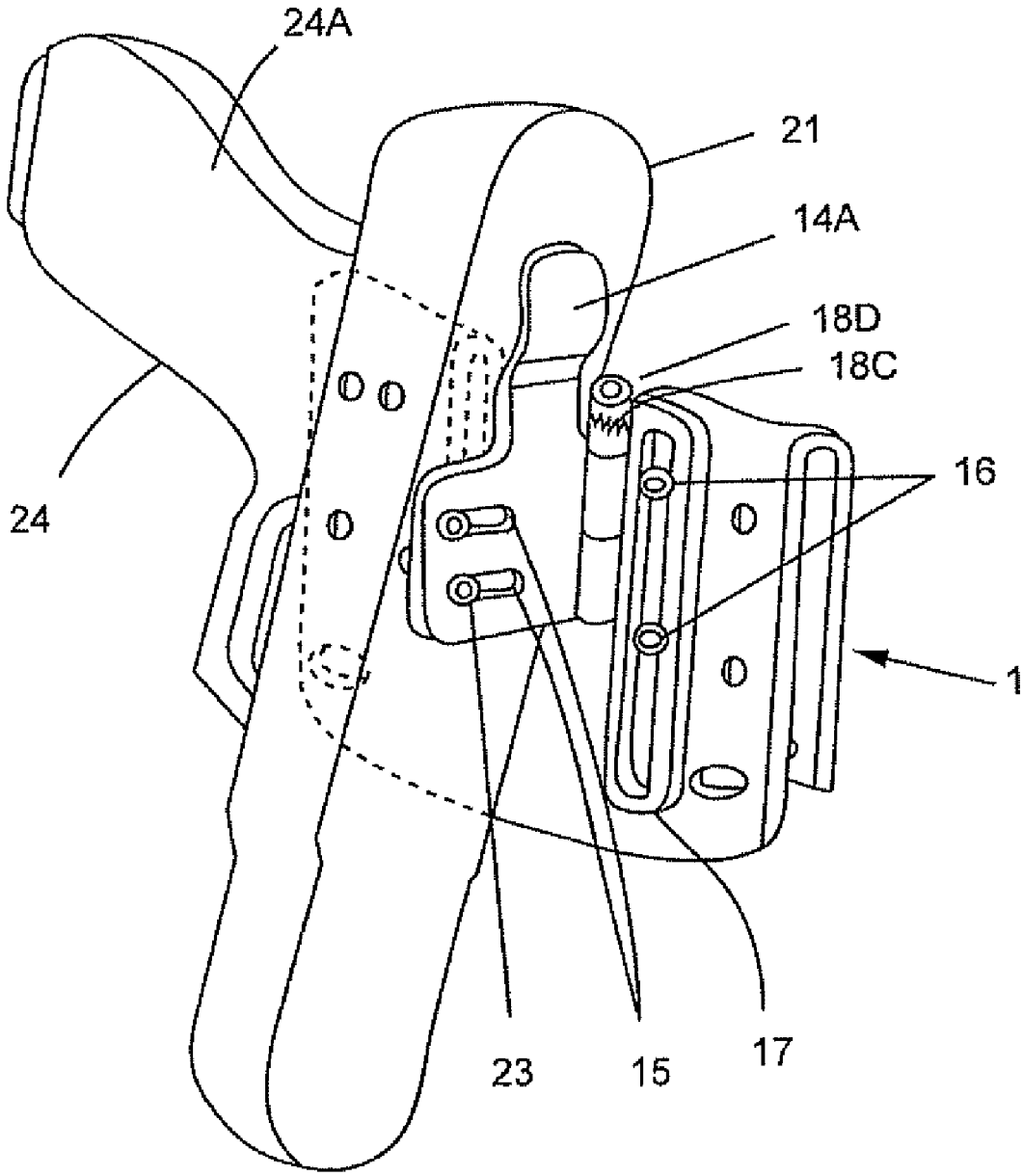
FIG. 8 is a view similar to the view of FIG. 7 showing the holster set at an angle in relationship to the hip plate mount.

With reference to FIGS. 6 and 7, shroud 21 of the lockable holster H has a pair of threaded holes 22 in face 21A of the shroud 21 to receive screws 23 passing through screw slots 15 in the plate 14 A for micro adjusting of the shroud 21 to the hip plate mount 1. Shown in FIG. 7 a pistol 24 is inserted in the shroud 21. The slots 15 are horizontal and elongated to position the shroud 14A, 14B at different spaced distances from the hip plate mount 1, e.g. with the screws 23 at the most inward position in the slots 15, the shroud 21 is close to the hip plate mount 1, and with the screws 23 at the most outward position, the shroud 21 is farther from the hip plate mount 1. As can be appreciated, the screws 23 in the slots 15 do not have to be vertically aligned with one another as shown in FIG. 7, but can be off set from one another, e.g. but not limiting to the invention, to position the shroud 21 at an inward angle to the hip plate mount 1 as shown in FIG. 8, or in an outward angle (not shown) relative to the hip plate mount 1. The plates 14 A, 14B are adjusted vertically by sliding the face plate 17 along the screws 15 and tightening the screws 15 to place the shroud 21 in a desired vertical position.

Figure 9:
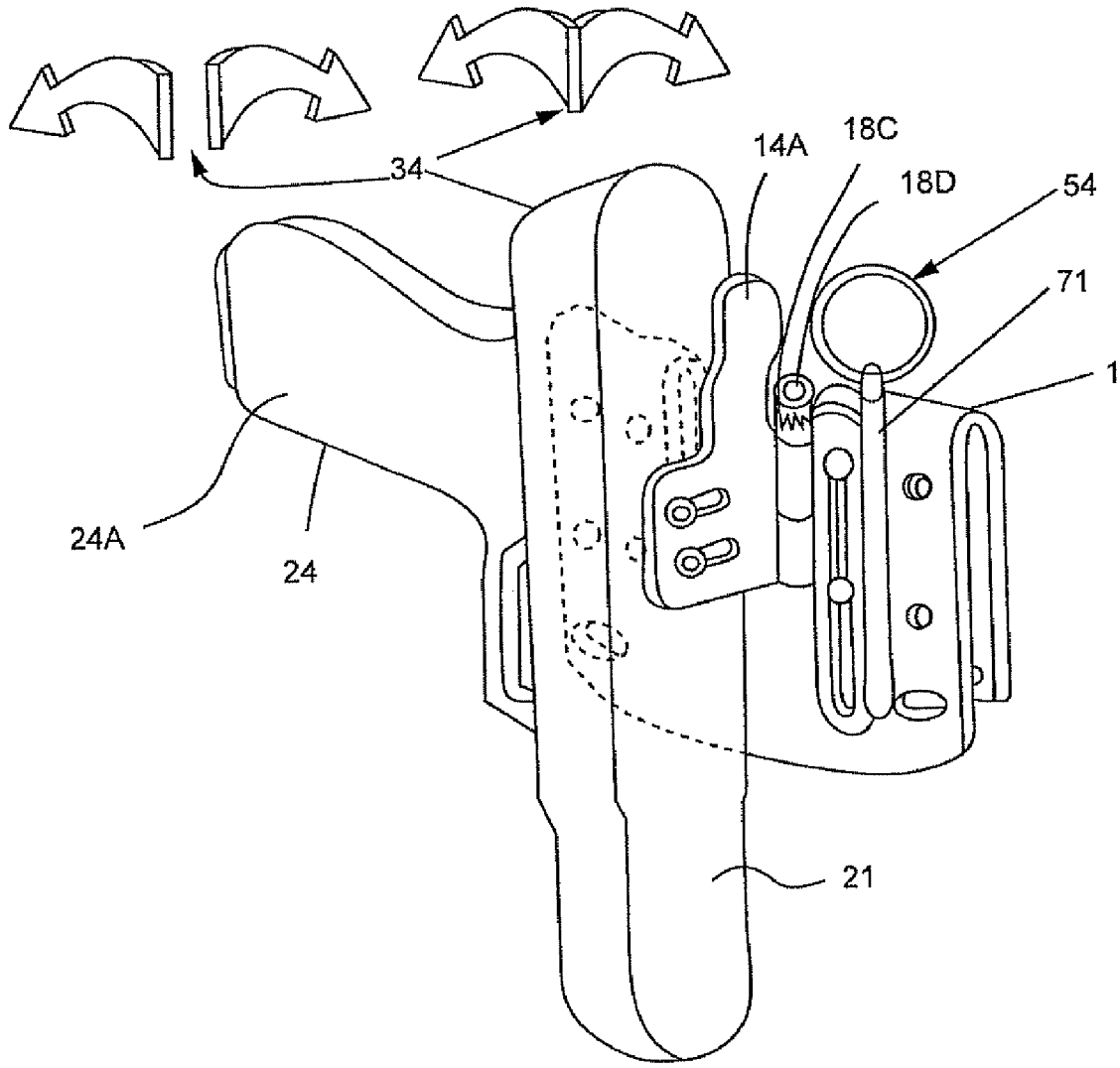
FIG. 9 is a view similar to the view of FIG. 7 showing a further non-limiting embodiment of the hip plate mount of the invention.

FIG. 9 shows the pistol 24 mounted in the shroud 21 in a vertical position to the hip plate mount 1. The pistol's grip 24A can be adjustable inward and outward relative to the hip plate mount 1 by rotating the plate 14A about the hinge 18D having teeth 18C (see FIG. 4A).

Figure 10:
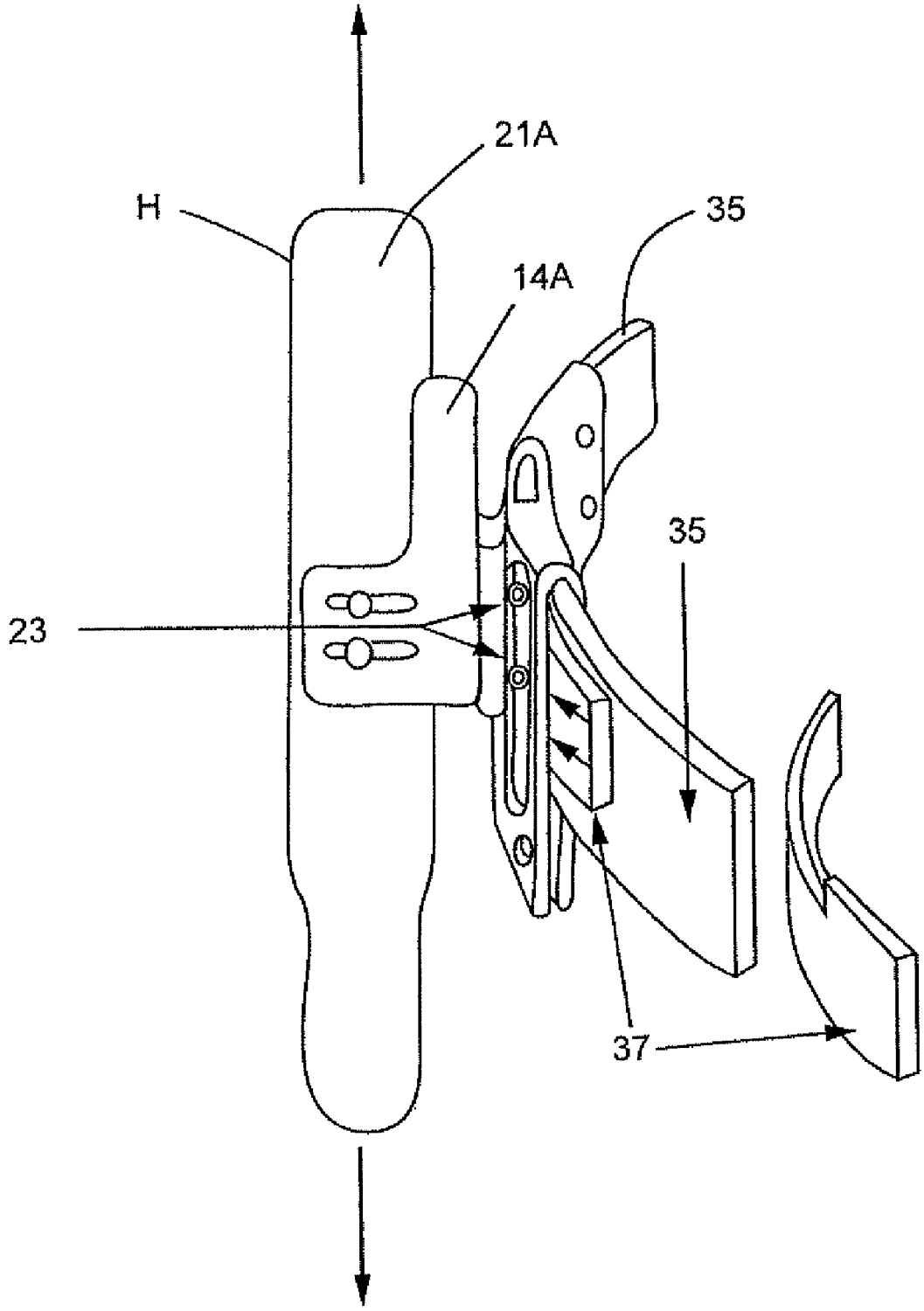
FIG. 10 is an elevated view of the hip plate mount and holster of the invention shown in FIG. 7 mounted on a belt in accordance to the teachings of the invention.

FIG. 10 shows the use of a shim 37 between the hip plate mount 1 and the belt 35. The shim 37 increases the thickness of thin belts to insure that the hip plate mount 1 is securely mounted on the belt 37.

The discussion is now directed to a non-limiting embodiment of a lockable holster H of the invention shown in FIG. 11 and designated by the alpha number 21A. More particularly, the holster shroud 21A has a spring loaded safety lever locking cam 43 different from the presently available locking arms by providing a hole 49 for receiving a locking pin, e.g. but not limiting to the invention, either a tactical locking pin 54 (see FIG. 12A) or a key-lockable security rod 55 (FIG. 12B). In a non-limiting embodiment of the invention, no contact is made between the locking pin and the safety lever 42 and differing from the presently available locking arms, wherein the safety lever 42 when pushed down would cause the cam locking element 43 attached to the safety lever 42 to exert torque on the screws 44 connecting the safety lever 42 to the cam-locking element 43. Under one non-limiting embodiment of the invention, the safety lever 42 can move up and down freely without any contact to the locking pins 54, 55 and still not release the pistol from its locked position as the presence of the locking pin through the shroud 21A prevents the bottom rear portion of the pistol 24 from exiting the holster shroud 21A, while at the same time assuring a totally locked position of the pistol 24 until the locking rod 54, 55 is removed.

Figure 11A:
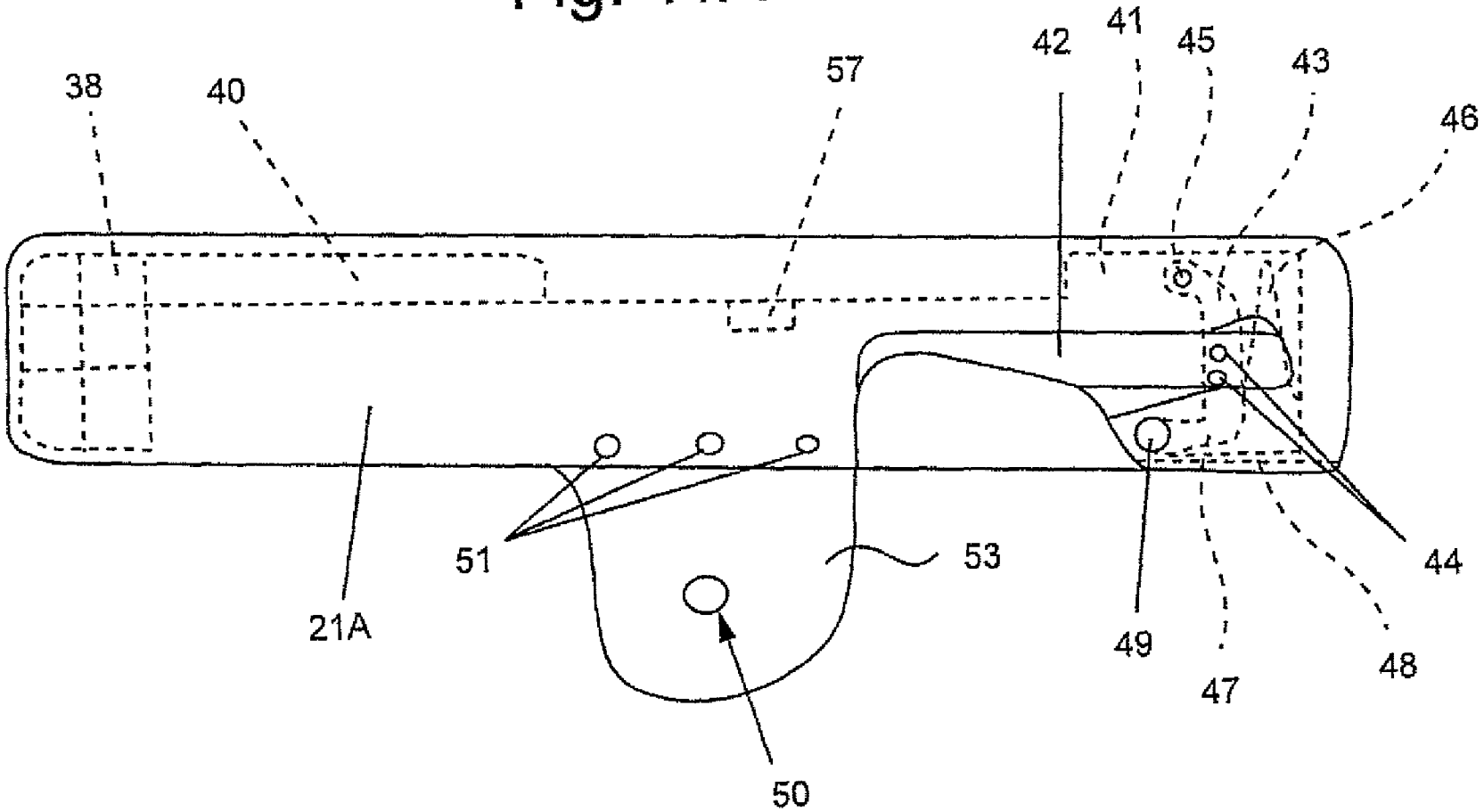
FIG. 11A is an elevated side view of another non-limiting embodiment of the holster of the invention having trigger guard shields.
Figure 11B:
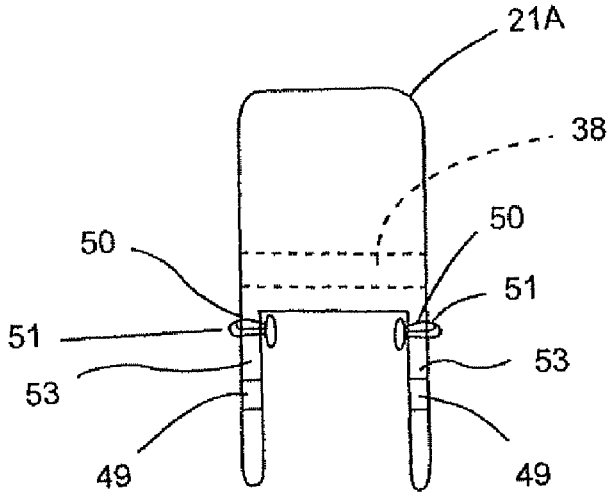
FIG. 11B is a side view of the holster shown in FIG. 11A.

More particularly, and with reference to FIGS. 11A, 11B and 12, with the pistol holstered in the shroud 21A (see FIG. 11A), the muzzle end 58 of the slide 59 of the pistol 24 is blocked from any further movement by the slide stop at 38 of the shroud 24A. Upon further downward pressure on the pistol's grip 24A, the receiver continues movement forward until it is stopped by the slide atop 38 of the shroud 24A as the receiver is capable of moving independent of the slide by compression of the recoil spring in a semi-automatic pistol. The amount forward the receiver travels corresponds exactly to the opening of the pistol chamber 39 (see FIG. 11C). The grooved portion 40 (see FIG. 11A) within the shroud 21A accepts the front sight of the pistol 24, and the groove 41 in the rear of the shroud 21A accepts the rear sight of the pistol 24. The grooves protect the sights from being in contact with any material causing misalignment or wear of the sight's blackened surface. The actuating safety lever 42 of the spring-loaded pivoting cam lock 43 is attached to the safety lever 42 by screws at 44. The pivoting pin 45 and compressible spring 46 are located between the back of cam lock 43 and the rear of the holster shroud 21A. The access shield 48 protects the distal portion 47 of the spring loaded pivoting cam lock 43, the compressible spring 46, and the spring loaded pivoting cam lock 43 from dirt, as well as any manipulation of the parts therein. The internal protrusion or chamber blocking boss 57 within the top of the shroud 21A, enters the partially opened pistol chamber 39, the chamber partially opens as the pistol 24 is inserted in the shroud 21A and pushed to its most downward position, and the pistol is locked into the shroud 21A. Upon the release of the downward pressure on the pistol 24, the receiver of the pistol 24 is forced back into a locked chamber position relative to the slide of the pistol, and the internal protrusion or locking boss 57 does not allow the chamber to fully close because the protrusion 57 is in the chamber 39.

With reference to FIGS. 11A and 11B, optionally, trigger guard shields 53 are mounted on the pistol shroud 21A by screws 51 threaded into receiving holes 50.

Figure 11C:
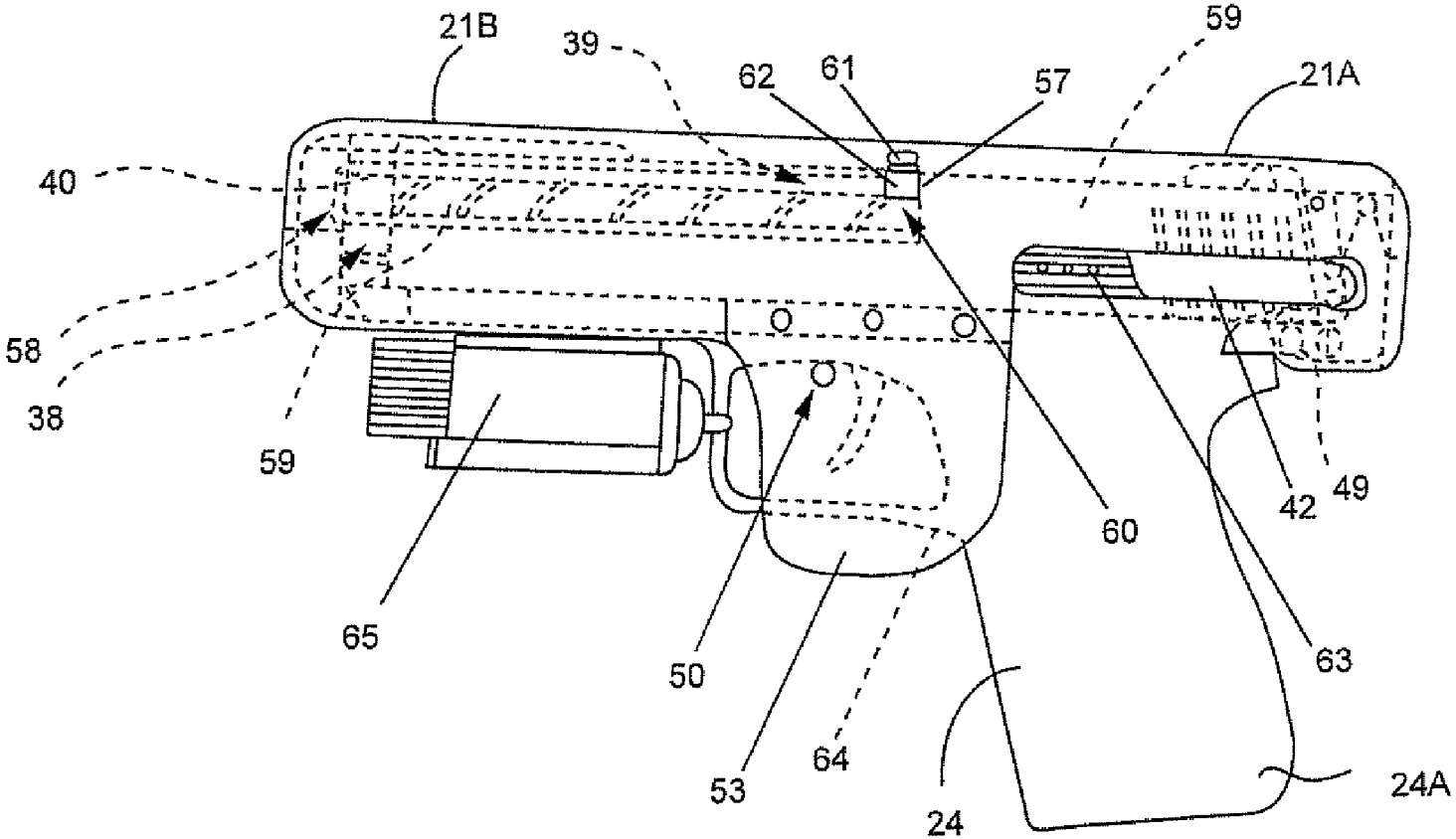
FIG. 11C is a view similar to the view of FIG. 11A having a pistol mounted in the holster in accordance to the teachings of the invention.

FIG. 11C is a cutaway view of the pistol 24 in the shroud 21A, showing a spring loaded pin 61 through the chamber blocking boss 57. The pistol 24 shown in FIG. 11C does not have a round in the partially opened chamber 39 and the spring loaded pin 61 is in a decompressed state with no protrusion of the pin 61 extending beyond the outer surface or front surface 21B of the holster shroud 21A. FIG. 11C also shows optional trigger guards 53 mounted to the shroud 21A with the hole 50 through the trigger guards 53 arranged to receive the tactical locking pin 54 (See FIG. 12A) or the key-lockable locking pin 55 (see FIG. 12B) to prevent rotation of the pistol out of the holster shroud 21A. The holes 49 (see also FIG. 11B) are provided on the rear back portion of the shroud 21A to receive one of the locking pins 54, 55, as discussed above. The trigger guard shield 53 mounted to the shroud 21A, as discussed above, also covers the pistol's magazine release button 64. FIG. 11C also shows a laser and/or light aiming module 65. The module 65 can be attached or removed without removing the pistol 24 from the holster shroud 21A, thereby allowing one handed access to the light aiming module 65 if it is not needed in conjunction with the pistol.

With continued reference to FIG. 11C, the semi-automatic pistol 24 is empty and positioned in line within the shroud 21A with the muzzle end 58 of the pistol blocked by the muzzle end slide block 38. The muzzle end 58 has entered the muzzle end receiving hole 40 of the shroud 21A in a partially forward position relative to the position of the contained slide. The chamber 39 of the pistol 24 is opened and blocked from closing fully by the blocking boss or pultrusions 57, which restricts the closing of the chamber 39, automatically placing the pistol in a non-fireable status as the trigger has been automatically disconnected from functioning. This feature is part of the semi-automatic pistol's safety design and is usually present, in all semi-automatic pistols. The pistol's barrel 59 does not have a cartridge present therein; thereby allowing the tip 60 of the loaded chamber indicator pin access into the empty barrel forced by the expansion of an encapsulated spring 61 within the blocking boss 57, allowing the loaded chamber indicator 62 to protrude into the empty barrel. The thumb-rest 63 which actuates the safety lever 42 of the spring-loaded pivoting cam lock 43 is accessible while the magazine release button 64 of the pistol is protected by the trigger guard safety shield 53.

Figure 12A:
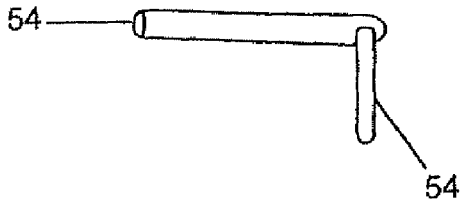
FIG. 12A is an elevated front view of a non-limiting embodiment of a locking pin of the invention.
Figure 12B:
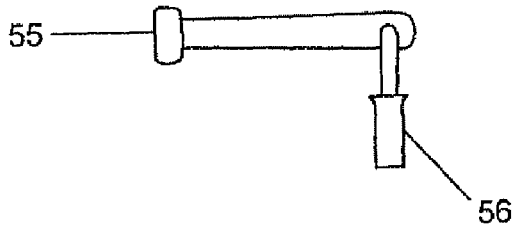
FIG. 12B is an elevated front view of another non-limiting embodiment of a locking pin of the invention.
Figure 13A:
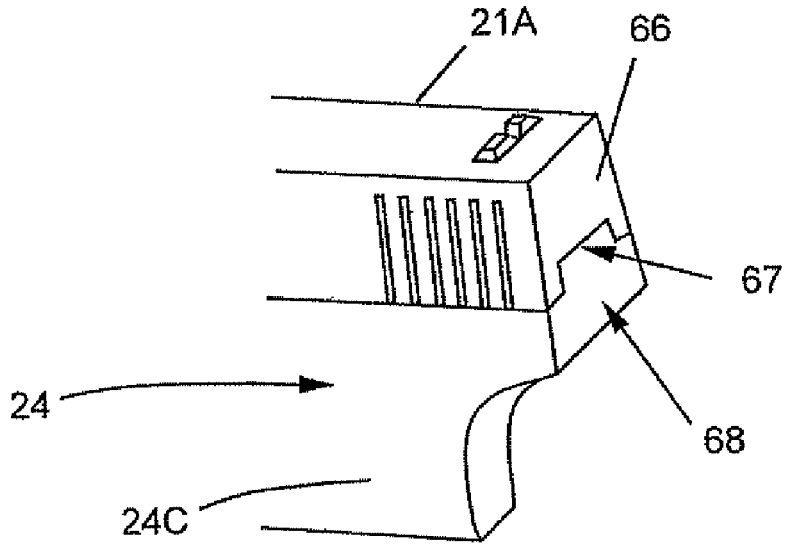
FIGS. 13A and 13B are end views of a pistol.
Figure 13B:
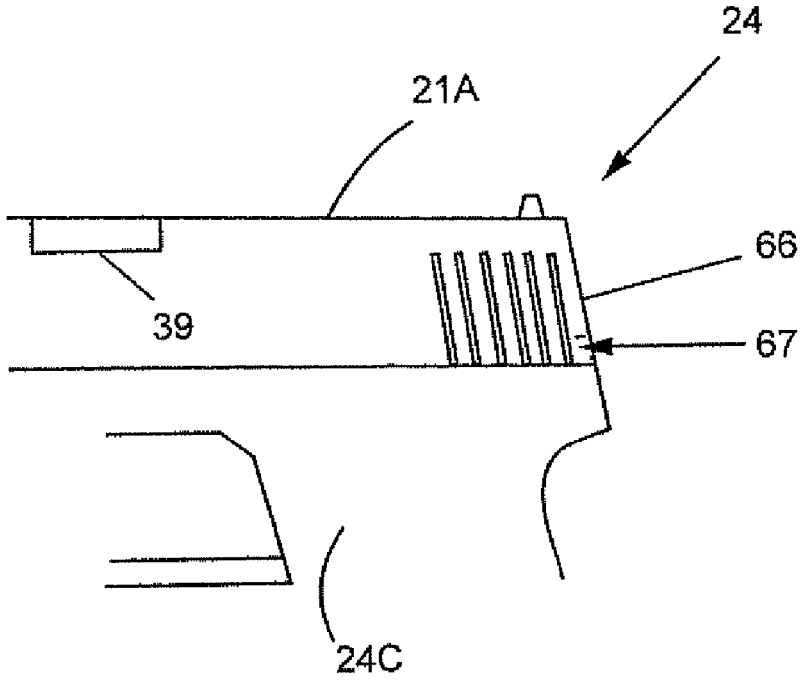
Figure 14A:
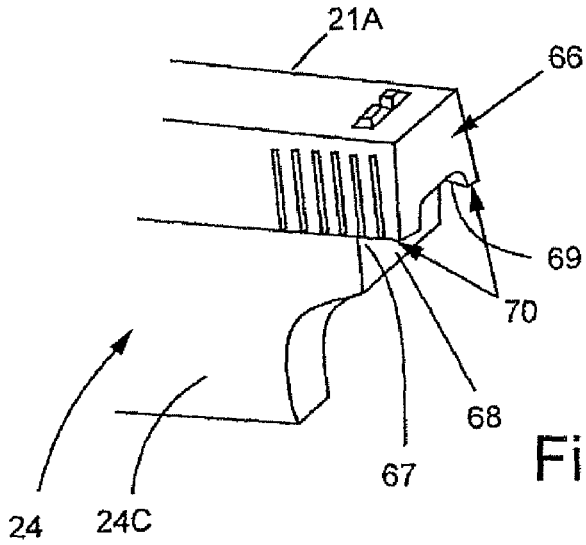
FIG. 14A is an end view of a pistol having the slide displaced to the rear of the pistol.
Figure 14B:
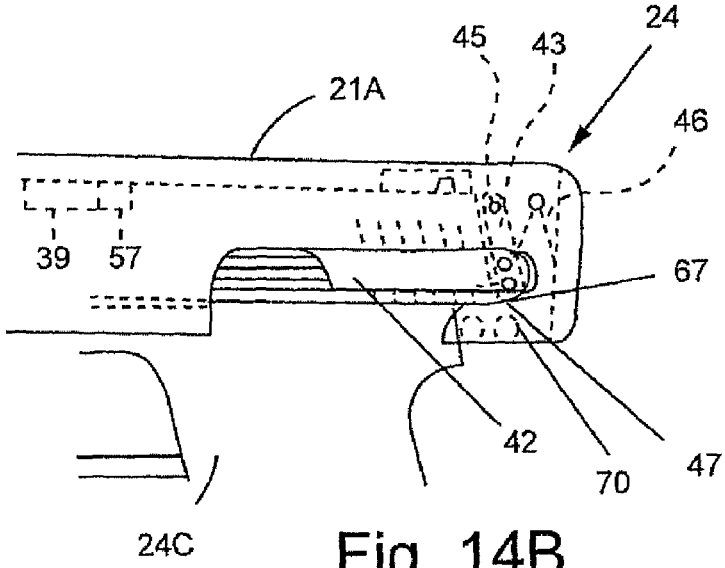
FIG. 14B is an end view of the holster of the invention and end view of a pistol mounted therein.

FIGS. 13A, 13B and 14A-14C depict a section of the back portion of the semi-automatic pistol 24 showing the positioning of the rear of the slide 66 to the frame 24C of the pistol 24 with the slide 66 moved to the rear, as shown in FIG. 14A, by the presence of the chamber blocking boss 57 (see FIG. 12) which, accordingly, repositions the partially opened slide 66 directly on top of the two through-holes 49 in the shroud 21A (see FIG. 11B) for positioning the tactical locking pin 54 (see FIG. 12A and/or key-lockable locking pin or security rod 55 (see FIG. 12B) in the holes 49. In FIG. 14B, the safety lever 42 is shown in an upward locked position with the hook 47 of the cam lock 43 engaging the under portion of the slide 66 when held open by the chamber blocking boss 57. With the safety lever 42 in this position and no locking pin 54, 55 (see FIGS. 12A and 12B) through any of the holes 49, the pistol 24 cannot be removed from the shroud 21A until the safety lever 42 is pushed fully down (see FIG. 14C), retracting the hook 47 on the camming locking lever 42 out of contact with the under carriage of the slide 66 and, in so doing, compressing the spring 46. In this position the pistol 24 will rotate out of the holster shroud 21A.

Figure 14C:
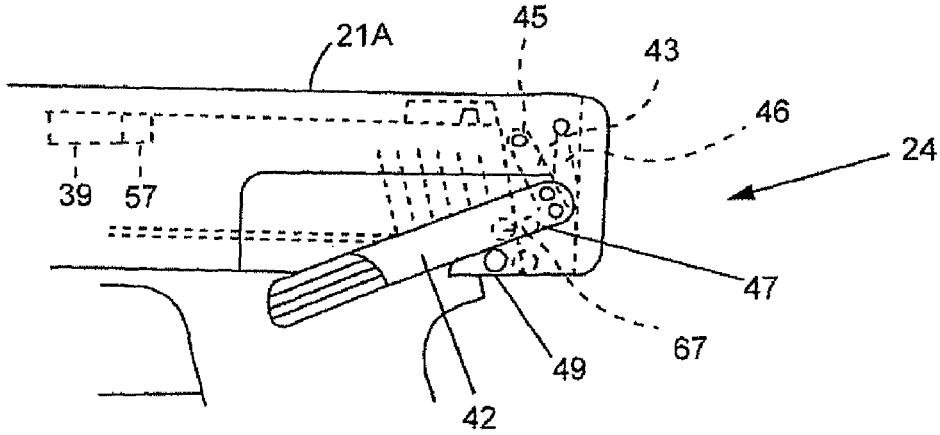
FIG. 14C is a view similar to the view of FIG. 14B showing the safety lever of the holster in a down or pistol release position.

Further, in regards to FIGS. 13A, 13B and 14A-C, and in particular to FIG. 12A, the number 67 represents the mating configuration between the rear end of the slide 66 and top rear 68 of the receiver of the pistol 24. In FIG. 13B, there is shown the side view configuration of the mating surface 67 with the pistol's chamber 39 completely closed when the rear end of the slide 66 and the top rear 68 of the pistol 24 are completely in line and mated at 67. FIG. 14A shows the widest opening 69 at the union juncture of the mating configuration 67 (clearly shown in FIG. 13A) between the rear end of the slide 66 and the top rear 68 of the pistol 24, as to the top portion of that union at 67. The bottom end section of the slide 66 is designated by the number 70. FIG. 14B shows the presence of the blocking boss 57 restricting the full closure of the pistol's chamber 39, thereby keeping the pistol's slide 66 relative to the pistol's receiver out of battery rendering the pistol unfireable. In one non-limiting embodiment of the invention, the length of the blocking boss 57, is exactly the same as the length of the muzzle end of the barrel protruding into the muzzle end of the shroud 21A (see FIG. 12). With reference to FIGS. 14B and 14C as needed, the spring-loaded pivoting cam lock 43 is held forward by the compressible spring 46 between the back of cam lock 43 and the rear of the holster shroud 21A. The distal portion 47 of the spring-loaded pivoting cam lock 43 is present in the formed crotch of mating configuration 67 of the now partially retracted slide 66 of the pistol 24, which allows the cam lock 47 to hook into the opening 69 (see FIG. 14A), which restricts the pulling out of the pistol 24 from the shroud 21A. More particularly, the union between the cam lock 47 and the compressible spring 46 between the back of the lock 43 and the rear of the shroud 21A prevents any successful attempt to withdraw the pistol from the shroud when the pistol is in this position. FIG. 14C shows the actuating safety lever 42 in the downward release position causing the cam lock 47 to pivot to the right or rear on the pivot pin 45 compressing the spring 46 and, in so doing, allowing the distal portion 47 of the spring-loaded pivoting cam lock 47 to move backward out of the mating configuration 67, thereby allowing the pistol to be removed by rotating the pistol 24 out of the holster shroud 21A (shroud 21A shown in FIGS. 11C, 14B and 14C). The action of removing the pistol 24 by rotating the grip 24A while the safety lever 42 is in the downward position (see FIG. 14C) changes the alignment of the pistol's slide 66 relative to the restriction caused by the blocking boss 57 blocking the rearward action of the pistol's slide 66 coming into alignment with the pistol's grip. The pistol's chamber 39 will close fully as the pistol is withdrawn from the shroud 21A, thus putting the trigger mechanism of the pistol into full operational status.

Figure 15A:
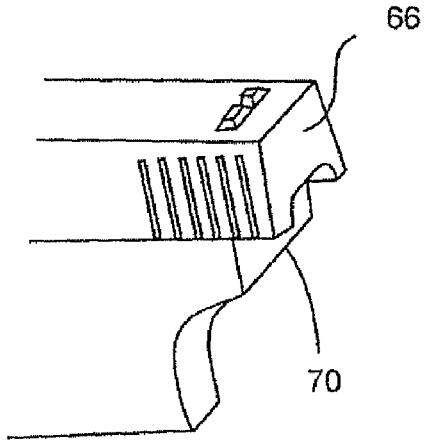
FIGS. 15A and 15B are similar to the views of FIGS. 14A and 14B, respectively.
Figure 15B:
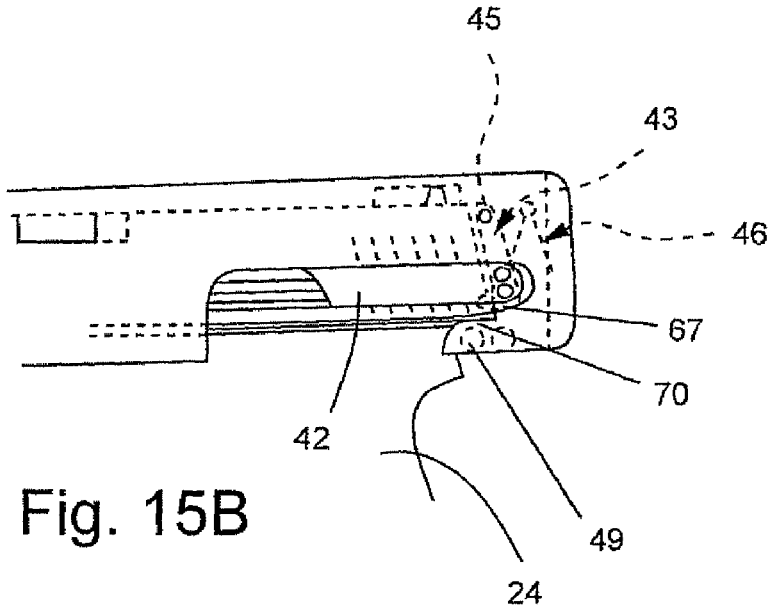
Figure 15C:
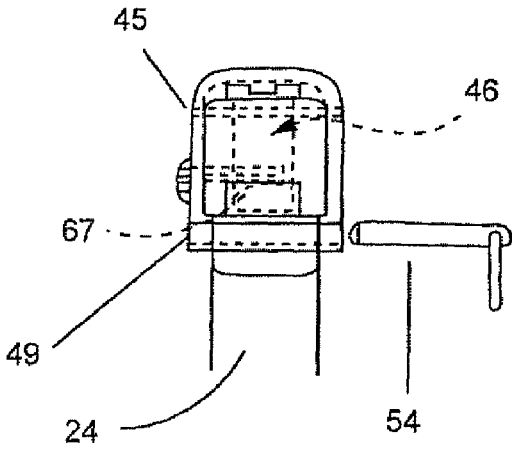
FIG. 15C is an end view of the pistol shown in FIG. 15A.
Figure 16A:
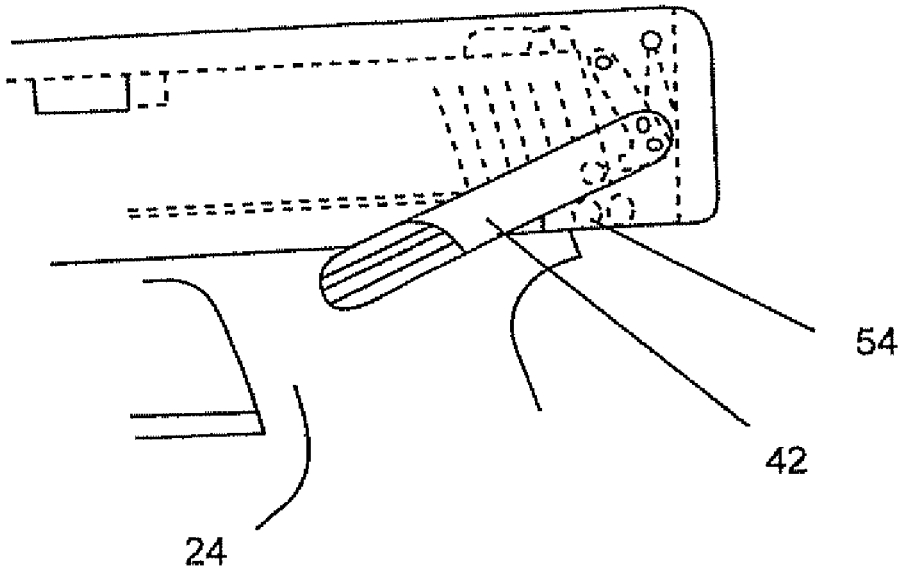
FIG. 16A is view similar to the view of FIG. 14C.
Figure 16B:
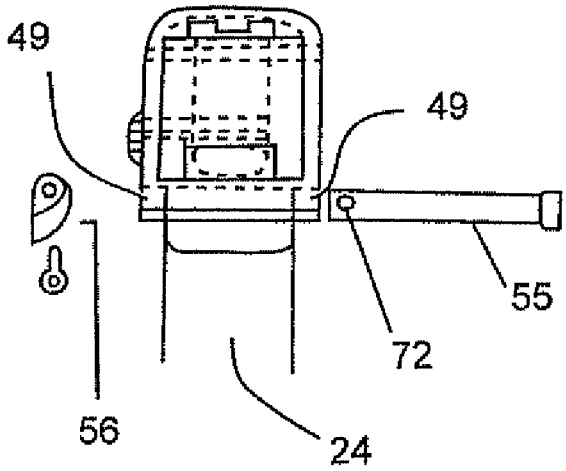
FIG. 16B is an end view of the pistol shown in FIG. 16A.

FIGS. 15A-C, 16A and 16B are related to the FIGS. 14A-C, discussed above, and are presented to show the rear view of the positioning of either the tactical locking pin 54 (see FIG. 15C) or lockable locking pin 55 (see FIG. 16B). More particularly, FIGS. 15A, 15B and 16A are similar to FIGS. 14A, 14B and 14C, respectively. FIG. 15B shows the spring-loaded pivoting cam lock 43 and the pivoting pin 45 and, the compressible spring 46 with the mating configuration 67 in position, as represented in FIG. 15C. More particularly, FIG. 15C shows the ball-bearing ringed tactical locking pin 54 in position of entry into one of the holes 49 through both sides of shroud 21A, which will be positioned directly under the bottom end section 70 of the slide 66 (see FIG. 15A), preventing the pistol 24 from being withdrawn from the holster shroud 21A (clearly shown in FIG. 12). FIG. 16A is similar to FIG. 14C and shows the actuating spring lever 42 in a downward open position moving all elements attached therein to the rear, however, the pistol 24 cannot be withdrawn from the shroud as the presence of either the locking pin 54 (shown in FIG. 15C) or the lockable locking pin 55, (shown in FIG. 16B) in the holes 49 of the shroud 21A will restrict the pistol 24 from withdrawal or movement in any direction. The locking pin 55 can be secured in the holes 49 of the shroud 21A by a securing padlock 56 in the hole 72 of the locking pin 55. On one non-limiting embodiment of the invention, the locking pin is mounted on the hip plate mount 1. As shown in FIG. 9, the locking pin 54 is in the receiver 71, inserted on the hip plate mount 1.

Figure 17:
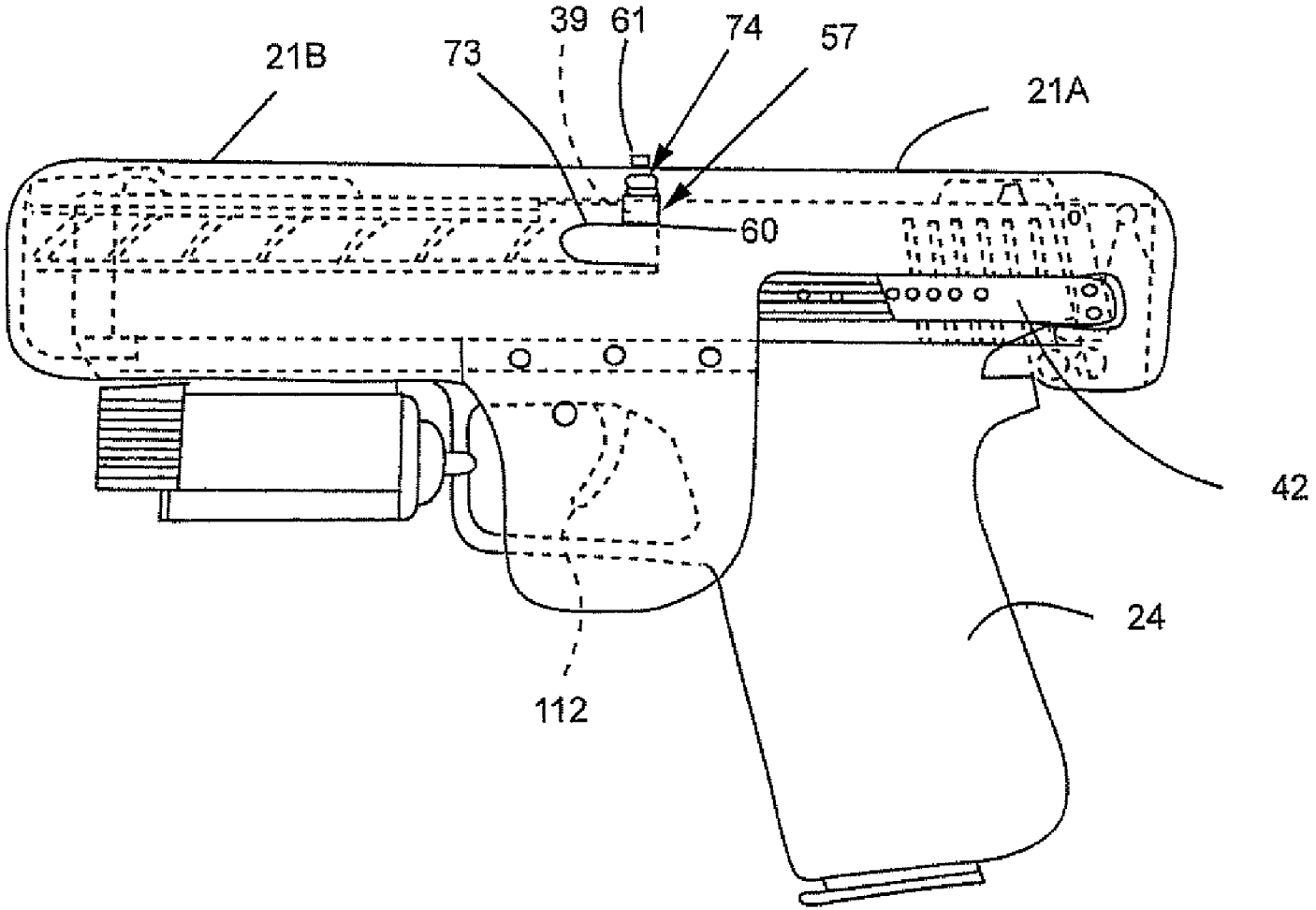
FIG. 17 is a view similar to the view of FIG. 11C showing a cartridge loaded in the chamber of the pistol and the holster of the invention having another non-limiting embodiment of a safety lever of the invention.

FIG. 17 shows a cartridge 73 in the barrel of the pistol 24 with the safety lever 42 partially to the rear, and the chamber 39 of the pistol 24 kept partially open by the chamber blocking boss 57. The cartridge's presence in the chamber forces the spring loaded pin 61 through the boss 57 upward, exposing the top of the pin 61 above the surface 21B of the shroud 21A to tactile confirmation that a cartridge or round is chambered. In one non-limiting embodiment of the invention, the encapsulated spring 61 within the blocking boss 57 is slightly compressed by the presence of the cartridge 73 in the chamber 39, bearing pressure on the tip 60 of the loaded chamber indicator pin. The tip of the loaded chamber indicating pin is forced upward, driving the pin upward by 1/16th of an inch above the surface 21B of the shroud 21A, causing a tactile recognition of the elevated position of the tip 60 of the loaded chamber indicator. When the officer's finger swipes the surface 21B of the shroud 21A, the presence of the upward driven tip 60 will indicate that there is a round present in the chamber of the pistol.

In FIGS. 18 and 19 there are shown different types of adjustable holsters safety levers 42A (FIG. 18) and 42B (FIG. 19) to accommodate varying finger size to facilitate actioning the safety lever. FIG. 18A shows two elements to the safety lever 42, one is a thumb rest 75 and the other is the mounting lever 75A. With continued reference to FIG. 18A, the thumb rest 75A has a slotted dovetail 75C that is moveably secured in slot 75D of the mounting lever 75C in any convenient manner. In this manner, the thumb rest 75 can be moved to any desired position in the slot 75D of the mounting lever 75A, and secured in position at any point by tightening the two oval ended set screws 75E against the base of the mounting lever 75C. The adjustable safety lever 42B shown in FIG. 19, has mounting lever 78 plurality of spaced holes 78A for positioning the thumb rest 79 into any position on the mounting lever 78, by screws 79A passing through the holes 78A of the mounting lever 78 into the thumb rest 78.

Figure 20:
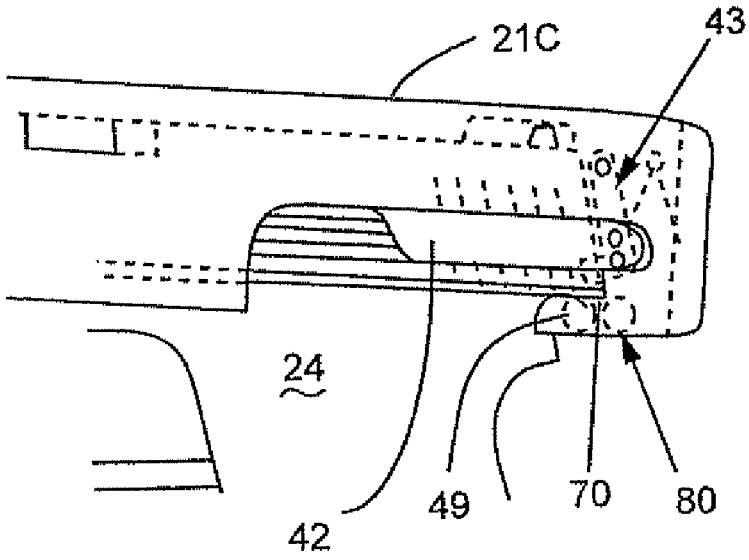
FIG. 20 is a view similar to the view of FIG. 15B.
Figure 21A:
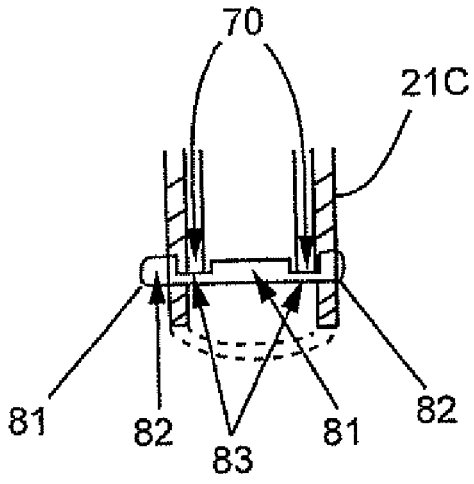
FIGS. 21A and 21B are partial end views of FIG. 20 showing a non-limiting embodiment of a pin of the invention moveable from an un-lock position (FIG. 21A) to a lock position (FIG. 21B).
Figure 21B:
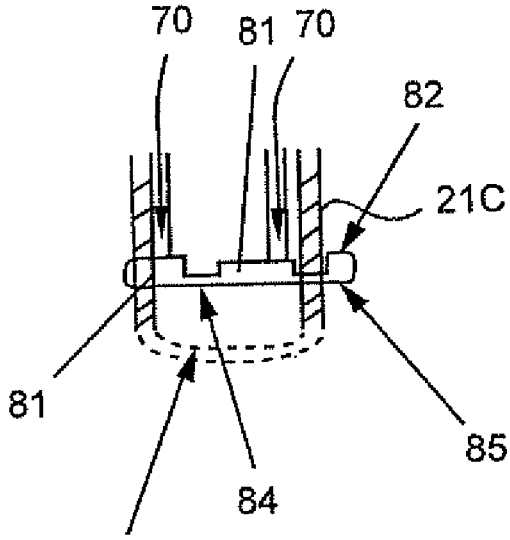

Shown in FIG. 20 is another non-limiting embodiment of a pistol shroud designated by the alpha number 21C. The shroud 21C is similar to the shroud 21A, but further includes a hole 80 through both sides of the holster shroud 21C for acceptance of another element of safety, a notched steel pin 81 (clearly shown in FIGS. 21A and 21B) which is received through the hole 80 and held in alignment by C clips, and rubber O-rings 82 on either end of the pin 81. FIG. 20 shows the non-removable grooved rod or notched steel pin 81 in an open position; that is, the notches 83 in the rod 81 present openings for the bottom of the safety slide 42 to rotate past the notches 83; however the pistol 24 cannot be withdrawn with the safety lever 42 in the up or on position (see FIG. 20). The rod 81 is an officer's option in lieu of the tactical locking pin 54 (see FIG. 12A). FIG. 16A shows the safety lever 42 in the down or off position, but the pistol's withdrawal from the holster shroud 21C is prevented by the pin 81 pushed outward (see FIG. 21B) presenting non-indexed portions of the locking pin 81 under the slide 66 of the pistol 24, preventing the pistol from being withdrawn, notwithstanding the down position of the safety lever 42. This feature of the invention provides protection from a rearward gun grab attempt in the event an aggressor should grab the pistol and push the lever 42 down. The pistol will not be removable from the holster shroud 21C with the pin 81 pushed in, preventing the pistol's slide 66 from clearing the solid position of the pin 81. This gives the officer, or person carrying the pistol, the ability to lock his/her pistol in the holster shroud 21C without the visible presence of the pin 81, but still having the security in close quarters that the pistol cannot be removed when the pin 81 is so indexed. When the officer determines that the conditions warrant his immediate access to the pistol, the pin 81 is pushed in the opposite direction, thereby allowing him/her to remove the pistol immediately upon depressing the safety lever 42. The pin 81 is secured in place by "C" clips and o-rings 82 on either end of the pin 81, indexed for either on or off positioning thereof.

FIGS. 22A and 22B and the discussion related thereto are directed to another non-limiting embodiment of the invention, relating to another arrangement of locking the pistol into the shroud 21C without inserting the tactical locking pin 54 shown in FIG. 12A. Notwithstanding, that the pistol 24 will be rapidly accessible to the officer by depressing the safety lever 42 (see FIGS. 15B and 16A) and rotating the pistol 24 out of the shroud 21C as long as the tactical pin 54 is not in place and/or the officer did not place the locking pin, e.g. the notched pin 81 (see FIGS. 21A and 21B) or rotatable locking rod 86, (see FIGS. 22A, 22B, 23A and 23C) in the locked position. More particularly, the rotatable locking pin or rod 86 is designed to rotate from north to south in a forward and down motion only. By positioning the solid, non-indented portion 86A of the rod 86 (see FIG. 22B) to engage the end 70 of the slide 66 of the pistol 24, the rod 86 is in the locked position. Rotating the rod 86 to expose the indented portion 86B of the rod 86 allows the end 70 of the slide 66 of the pistol to clear the holster shroud 21C. The pistol 24 can only thereafter be removed by depressing the holster safety lever 42 (see FIG. 15A) down, as long as the tactical pin 54 is not present in the holes 49 (see FIG. 11B) and, the internal locking rod 86 is positioned to the un-locked position, e.g., the down/off position discussed in more detail below. In both this, as well as the above discussed internal locking rods, the officer can determine which one of the two additional discreet locking mechanisms to use in close quarters with the general public or in transferring prisoners.

FIG. 15B shows actuating safety lever 42 in the locked position, and FIG. 22A shows the bottom end section 70 of the slide 66 (see FIG. 15B), bearing on the non-indented portion 86A of the rotatable locking rod or pin 86. With the locking rod 86 thus positioned, the pistol 24 cannot be withdrawn as the locking rod 86 is bearing on the bottom end 70 of the slide 66. The rod 86 is shown in FIGS. 22A and 22B in the upward locked position which is controlled by the upward positioning of rotating locking rod actuator pin 88 on the officer's side of the locking rod 86. The rotation of the rod 86 is limited by a semi-circular hole in the side of shroud 21D (see FIG. 24), where the pin 88 is located, allowing the pin 88 to only rotate 180 degrees from the up or down forward position. As shown in FIG. 22B, the rotating locking rod 86 can have a position arrow 90 engraved on its exposed end in alignment to indicate the position of the rod 86, e.g. with the arrow pointing in the up direction the pin 86 is in the locked position. In one non-limiting embodiment of the invention, the rotating locking rod actuator pin 88 is made so that it has a larger head than the diameter of the rod 86 and that the rotatable locking rod threaded retaining cap 89 is also a larger diameter than that of rod 86. With the actuating safety lever 42 moved to an unlocked position (as shown in FIG. 16A, the arrow 90 in the down position (see FIG. 23B) and the spring-loaded pivoting cam lock 43 compressed to the rear placing the top rear 70 of the pistol's slide 66 directly in line with the indented portion 86B of the rod 86, the slide 66 is free to move through the indented portion 86B of the rod 86 as the lever 42 is held down and the pistol 24 is rotated out of the shroud 21D, allowing the pistol 24 to go into battery, as it is now free of the blocking boss 57 in the pistol's chamber 39.

Figure 25:
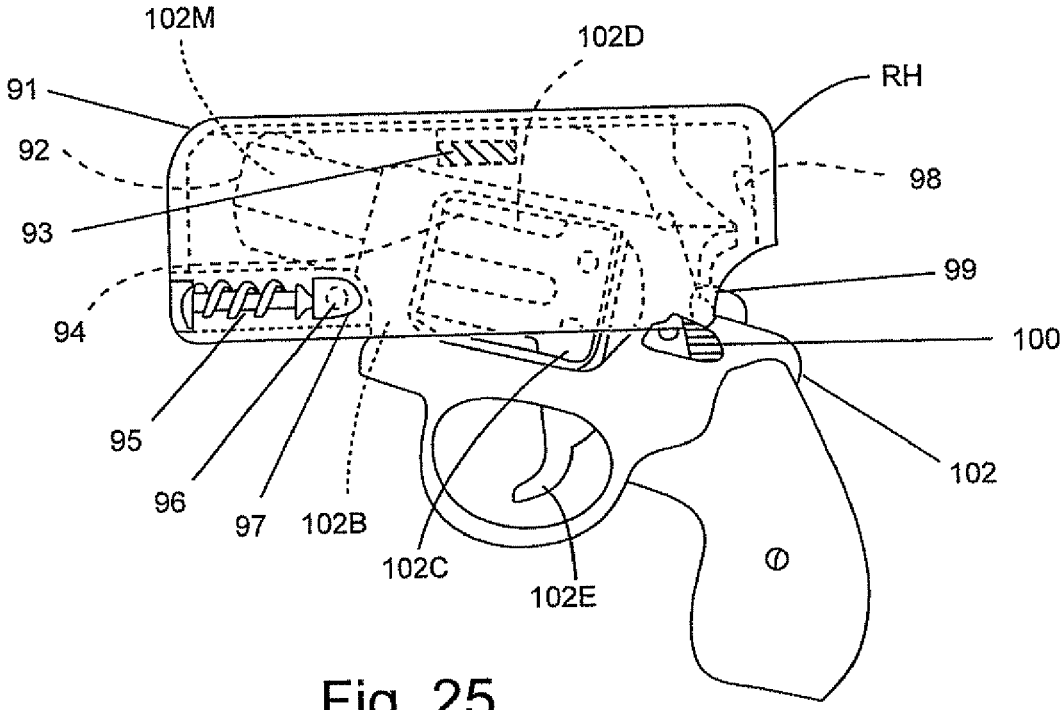
FIG. 25 is a front view of another non-limiting embodiment of a holster of the invention with a hammer type revolver being moved into the holster.
Figure 26:
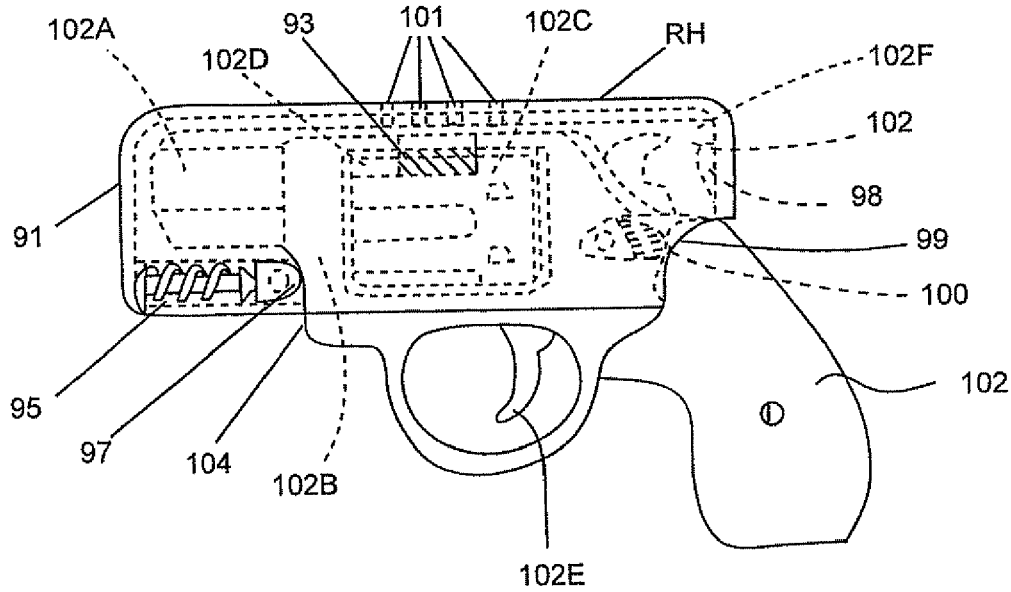
FIG. 26 is a view similar to the view of FIG. 25 with the revolver initially mounted in the holster and compressing the spring of the holster.
Figure 27:
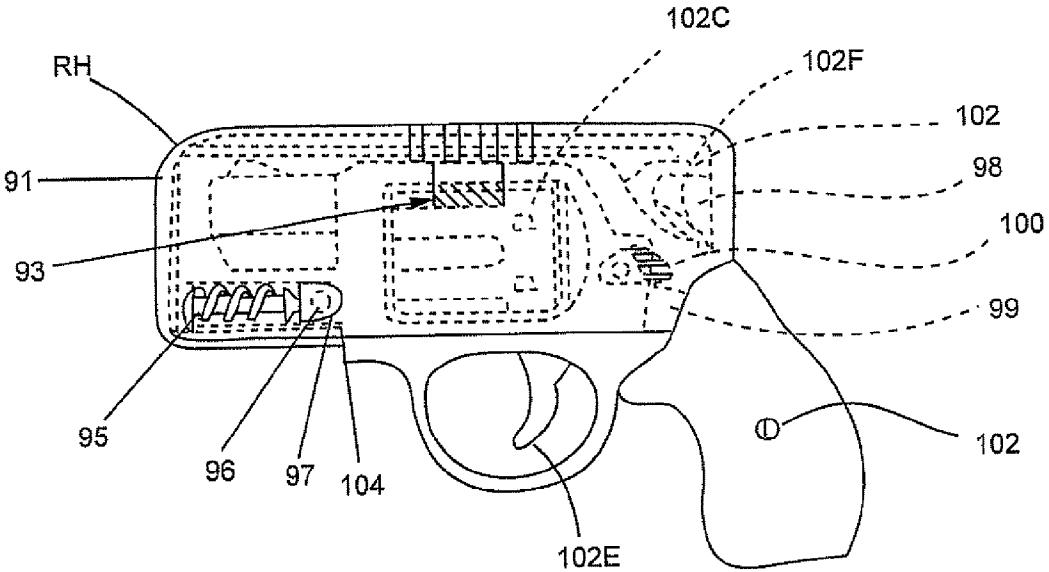
FIG. 27 is a view similar to the view of FIG. 25 with the spring biasing the revolver in the holster toward the back of the holster.
Figure 28:
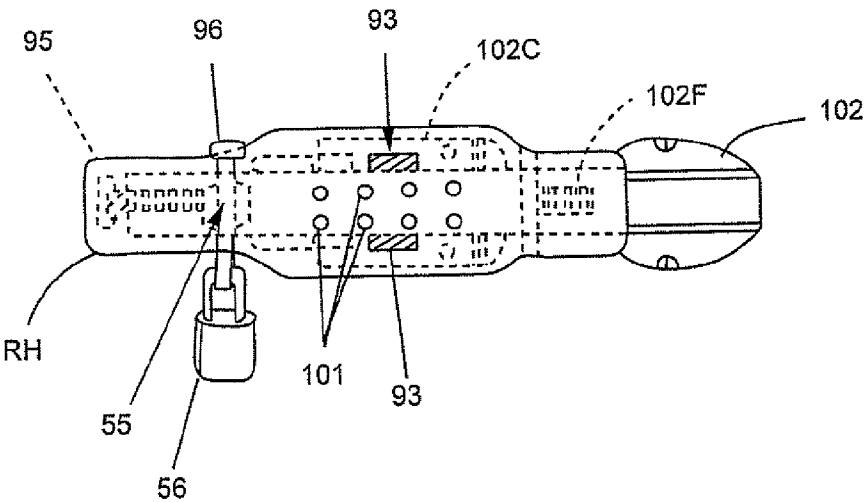
FIG. 28 is a top view of the holster and revolver shown in FIG. 27 with the holster having the locking pin shown in FIG. 12B.

With reference to FIGS. 25-28 as needed, the discussion is directed to a non-limited embodiment of the invention of a shroud 91, of a holster for a revolver 102. The shroud 91 and the shrouds 21A and 21D can be mounted to the adjustable hip plate mount 1 (see FIGS. 1-5) in a similar manner as the shroud 21 was mounted to the hip plate mount 1. Shown in FIG. 25, the nozzle end 92 of the hammer type revolver 102 is moved into the shroud 91 of the revolver holster RH, by compressing the spring plunger element 95 securely mounted in the shroud beneath the barrel 102A of the revolver 102. As the revolver 102 moves into the shroud 91, the spring element 95 compresses against the frame 102B of the revolver, as the revolver is rotated upward and forward in parallel with the shroud 91. FIGS. 25 and 28 show a pair of protruding anti-rotational locking bosses 93 on the inner surface of the shroud 91 located above the indented portion of cylinder 102C of the revolver 102. FIG. 26 shows the revolver placed vertically to its furthest point forward exerting maximum compression on the spring plunger element 95, bearing on the frame 102B of the revolver. The protrusion bosses 93 enter the right and left sides of the grooves102D of the cylinder 102C allowing the top of the revolver 102 to pass in between the protrusion bosses 93 (see FIG. 28). The function of these protrusion bosses 93 is to enter the grooves 102D of the cylinder 102C making contact therewith and, in so doing, act as anti-rotational cylinder locking bosses. As revolvers of the type under discussion work by the cylinder 102C, revolving when the trigger 102E is pulled, the presence of the protrusion bosses 93 in selected ones of the grooves 102D of the cylinder 102C restricts any movement of the cylinder 102C, hence the cylinder 102C is locked and the trigger is automatically locked. With reference to FIG. 28, there is a plurality of holes 101, and not limiting to the invention's eight holes 101, in the shroud 91 for mounting the multi-directionally mountable hip plate mount 1 on the shroud 91, as discussed above for the shroud 21. The shroud 91, like the shroud 21, is mounted from the front in three different positions as to height, thereby substantially narrowing the width of the holster making the carry of any revolver holstered in the shroud 91, mounted to the hip plate mount 1, much more concealable and requiring less material, and hence less expense, to manufacture. It should also be noted that of the design of the shroud 91 of the invention provides a shroud that is shorter and considerably thinner than the holster discussed in, and shown in FIGS. 1A-12C, of United States Published Patent Application No. US2005/00224537

More particularly and with reference to FIG. 25, the captured spring plunger element 95 includes a pin access hole 96 and a plunger element bearing surface 97. The revolver shroud 91 includes an internally protruding surface 98, which functions as a trigger downward stop. The grooved internal notch 99 of the shroud 91 accepts the cylinder release lever 100 when the revolver 102 is aligned within the shroud 91. Referring now to FIG. 26, as previously mentioned, the screw holes 101 adjust the height of the shroud on the multi-directionally adjustable hip plate mount 1. In FIG. 26, the revolver 102 is pushed forward into the shroud 91, applying pressure on the plunger element bearing surface 97 compressing the captured spring plunger element 95 bearing on the revolver frame 104. The cylinder release lever 100 of the revolver 102 is in an in-line position with the grooved internal notch 99 of the revolver shroud 91, to secure the revolver in the shroud.

FIGS. 26 and 27 are each a side view of the revolver 102 being pushed to the rear of the holster shroud 91 by the expansion of the compressed spring element 95 beneath the barrel 102A of the revolver 102. The biasing action of the spring element 95 pushes the revolver back toward the internally protruding surface 98, with the hammer 102F of the revolver 102 bearing upon the top rear portion of the protruding integral surface 98 of the shroud 91. The protruding surface 98 prevents the hammer 102F from going to the rear upon pulling the trigger 102E of the revolver 102. The revolver is now in a non-fireable or locked position. More particularly, the trigger 102E can not go to a cocked firing position, as it is stopped from rearward motion by the protruding surface 98, and the locking bosses 93 prevent the cylinder 102C from moving into a fireable position, as discussed above. In the locked position, the cylinder release lever 100 of the revolver is in the internal grooved notch 99 section of the shroud 91 to restrict any pulling of the revolver 102 out of the holster shroud 91. To release the revolver 102 from the shroud 91, the revolver 102 is pushed down to fully compress the spring loaded element 95, and the revolver 102 is rotated down and to the rear of the shroud 91, clearing the shroud 91 with a short stroke of ¼ inch. FIGS. 27 and 28 show optional locking holes 96 to receive either of its locking mechanisms discussed above, as well as the integral portions of the top of the shroud representing the anti-rotational locking bosses 93 preventing motion of the cylinder 102C upon any forceful movement of the trigger as discussed above.

With reference to FIG. 27, the spring plunger element 95 is expanded after the downward pressure is released following the holstering of the revolver 102 in alignment with the shroud 91. The biasing action of the expanded spring plunger 95 drives the plunger element bearing surface 97 to bear firmly against the revolver frame 104 pushing the revolver 102 to the rear of the shroud 91 allowing the spur of the hammer 102F to enter and bear upon the internally protruding surface 98. Simultaneously, the cylinder release lever 100, in its rearward travel, rests within and on top of the grooved internal bearing notch 99. With the revolver holstered into the shroud 93, the anti-rotational cylinder locking bosses 93 engage the cylinder 102C of the revolver 102 restricting the cylinder from movement when the trigger 102E is pulled. Additionally, the trigger 102E of the revolver 102 is prevented from moving backward when the trigger is pulled by its captured status within internally protruding surface 98, as discussed above. Consequently, the revolver cannot be fired while in the holster shroud 91. With continued reference to FIG. 28, the locking pin access hole 96 passes through the plunger element bearing surface 97. The locking pin 55 is secured by the key-lockable padlock 56, thereby preventing any forward motion of the revolver 102, which would allow the hammer 102F of the revolver to move from its captured position on the internally protruding surface 98. The cylinder release lever 100 is freed from its captured position in the grooved internal notch 99 of the shroud 91.

Figure 29:
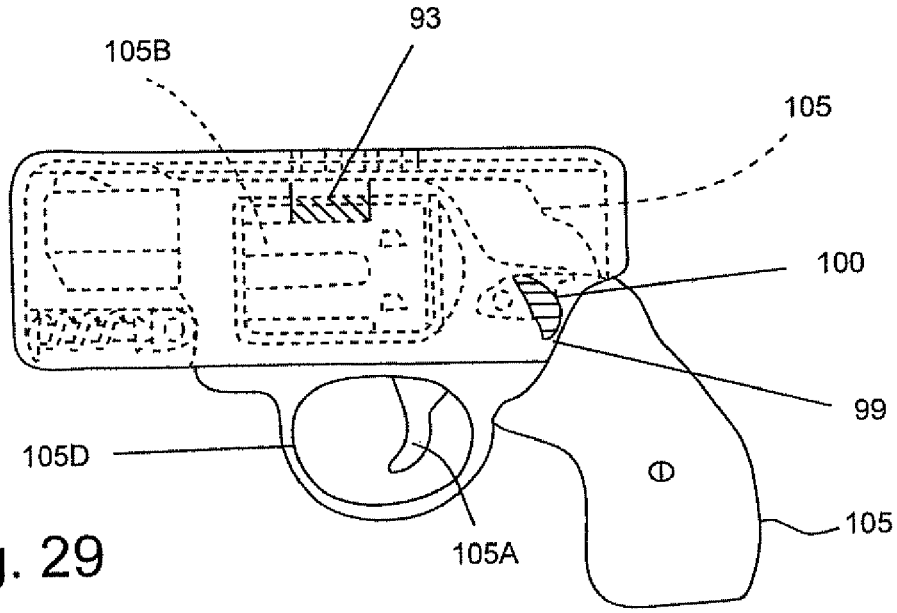
FIG. 29 is a view similar to the view of FIG. 26 showing a hammerless revolver mounted in another non-limiting embodiment of the invention.
Figure 30:
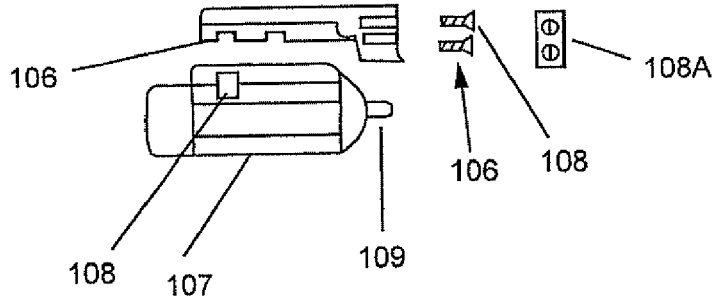
FIG. 30 is an exploded view of a mounting arrangement of the invention for mounting a laser/light to the trigger guard of a pistol and revolver.
Figure 31:
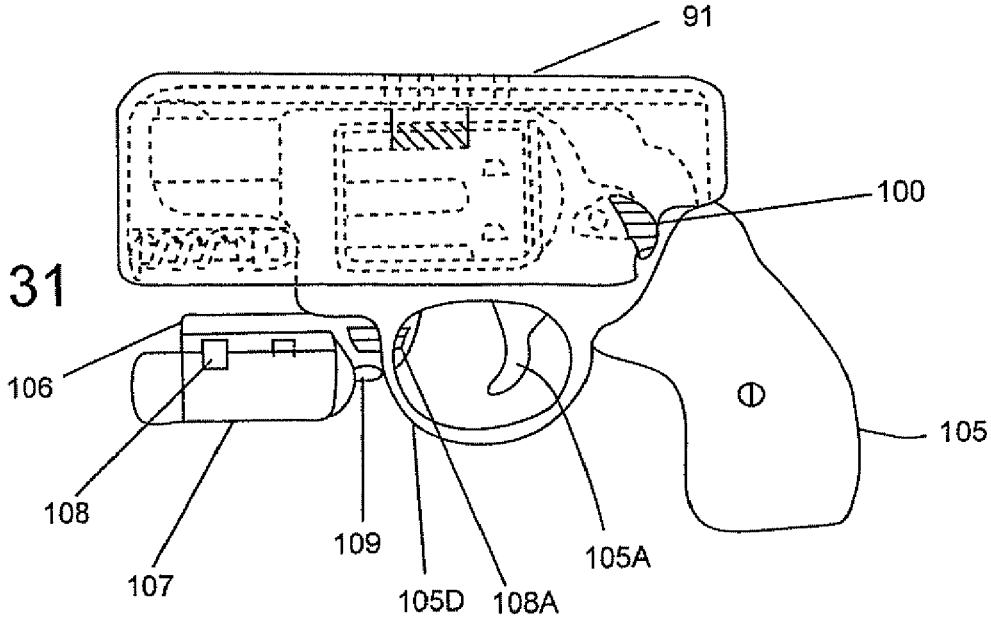
FIG. 31 is a view similar to the view of FIG. 27 showing the laser/light mounted on the trigger guard of the revolver mounted in the holster of the invention according to the teachings of the invention.

Shown in FIGS. 29-31, is the holster shroud 91 having a hammerless type revolver 105 with the anti-rotational locking bosses 93 restricting any movement of the trigger 105A, as the cylinder 105B of the revolver 105 cannot rotate. As a hammerless type revolver has an internal hammer, a revolver of this type would be able to fire within the holster as there is no way to contain an unexposed hammer. Consequently, the prevention of the revolver 105 from firing in the holster shroud 91 by pulling on the trigger is prevented by stopping any rotation of the cylinder by the bosses 93, as discussed above. FIGS. 29 and 31 show the cylinder release lever 100 fully encapsulated within the integral element of the holster shroud 91, restricting the revolver's removal from the holster shroud unless the drawing protocol, as previously described, is executed. Shown in FIG. 30 is a non-limiting embodiment of the invention of a mount 106, securely mounted between the outward and inward portion of the front of the trigger guard 105D by a securing arrangement 106A, including screws 108 and a plate 108A. A laser and/or light attachment 107 is mounted on the mount 106, as shown in FIG. 31, in a manner discussed below. The mount or light rail attachment 106 will not restrict the opening of the cylinder or reloading or cleaning the revolver. The presently available holsters are generally not designed to accept a revolver having an attached laser/light element and, if designed to accept a revolver having such elements, the holster would be excessively bulky as well as restricting the revolver's re-holstering. The holster shroud 91, of the invention, allows a person to carry a revolver, which is totally safe and inoperative, automatically locked in the holster and un-fireable until the weapon is drawn, while, at the same time, the light rail attachment allows a revolver carrier to be able to have optics readily available on the pistol itself for use with the revolver and pistol. The light and laser element 107 can be quickly and easily removed from the rail attachment 106, without removing the revolver from the shroud by the depression of the locking lever 108 on the light element 107.

Consider now the elements of the invention shown in FIGS. 29-31. FIG. 29 shows the hammerless revolver 105 locked within the revolver holster shroud 91A with the cylinder release lever 100 captured by grooved internal notch 99 and with the alignment and capturing function of the anti-rotational cylinder bosses 93. FIG. 30 shows a mount 106 of the invention for attachment of a light/laser unit 107 onto the mount by a spring loaded engaging element 108. The light/laser unit 107 is a readily available light optic unit which attaches to the receiver rails 105D of the trigger guard of the revolver 105. With reference to FIG. 31, the mount 106 is secured into position by the backing plate 108A and the screws 108 positioned behind the forward position of the trigger guard, and the screws 108 threaded into the mount 106 to secure the mount 106 onto the trigger guard. The spring loaded engagement element 108, having the laser/light 107 in spring loaded engagement thereto, is secured to the mount 106. The weapon optics is powered on and off by an on/off toggleswitch 109 of the weapon optics.

Figure 32:
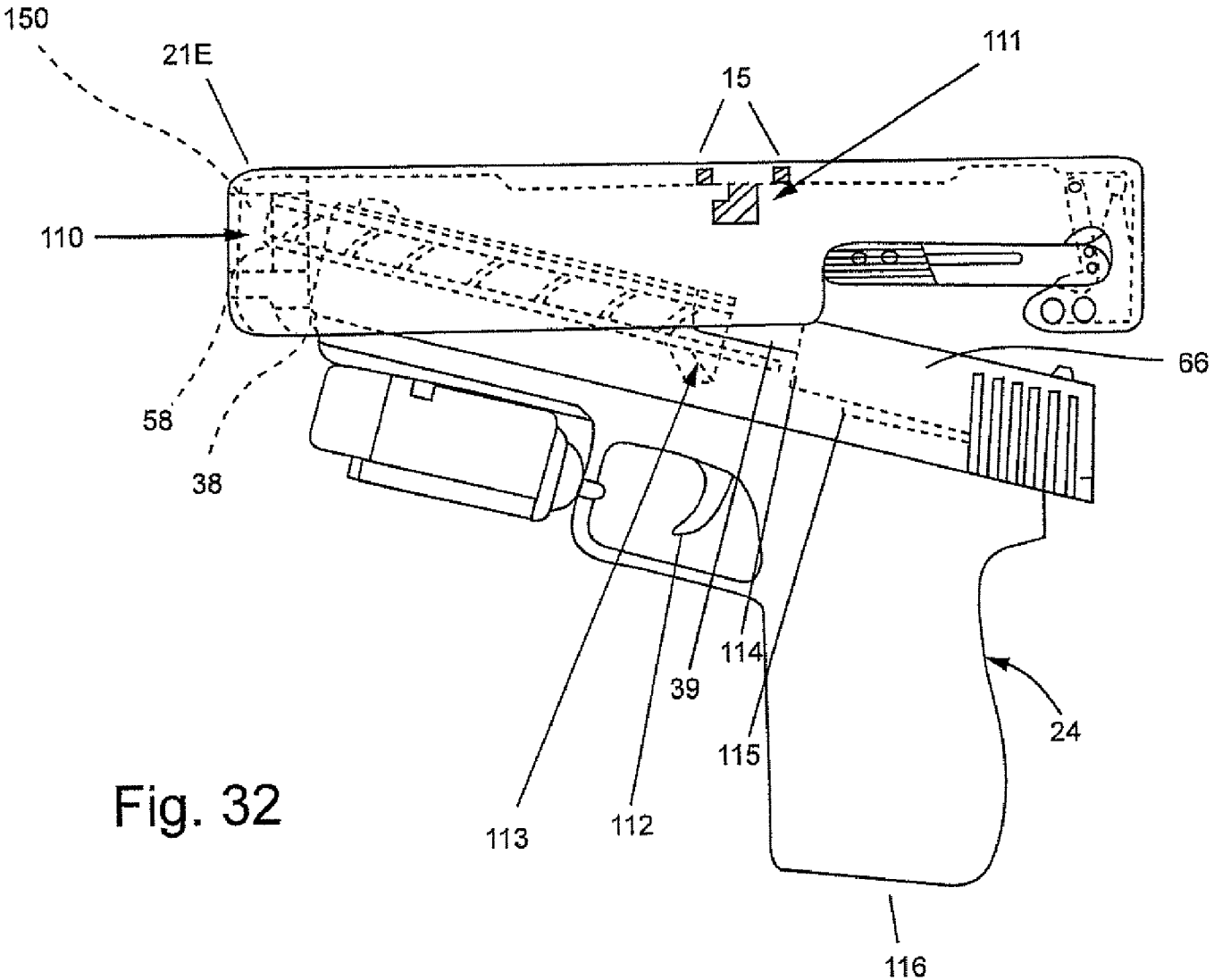
FIG. 32 is a side view of a pistol being moved into still another non-limiting embodiment of a holster of the invention.

In general, FIG. 32 shows an unloaded semi-automatic pistol being inserted into the holster shroud of the invention, without a magazine present in the pistol's receiver. The pistol's slide is bearing on the internal front portion of the slide, which stops any further movement of the slide, but allows the barrel to enter the muzzle entry port as the gun is pushed in. The top rear portion of the slide upon entering the holster shroud, will contact the oval-shaped lower portion of the cam locking element, which will force it to the rear against the spring tension connected to the slide spring tensioned locking cam, allowing the pistol entry into the shroud in perfect parallel to same. In so doing, the shroud's top mounted slide locking lug will enter into the chamber of the pistol, aligning itself with the opening for the barrel.

Specifically and with continued reference to FIG. 32, a hole 110 in the muzzle end of the holster shroud 21E passes the muzzle end 150 of barrel 158 of pistol 24. As the pistol 24 is moved into the shroud 21E, the slide 66 of the pistol 24 bears on the muzzle end slide block 38 to open the chamber 39 coming in line with a locking lug boss 111 mounted in the shroud 21E. As the slide 66 is opened, the trigger 112 is in an inoperative position. The feed ramp 113 of the barrel of the pistol 24 and the receiver 116 in the grip of the pistol are empty. The breech face of the slide 66 is identified by the number 114, and the protruding underside follower of the slide is identified by the number 115.

Figure 33:
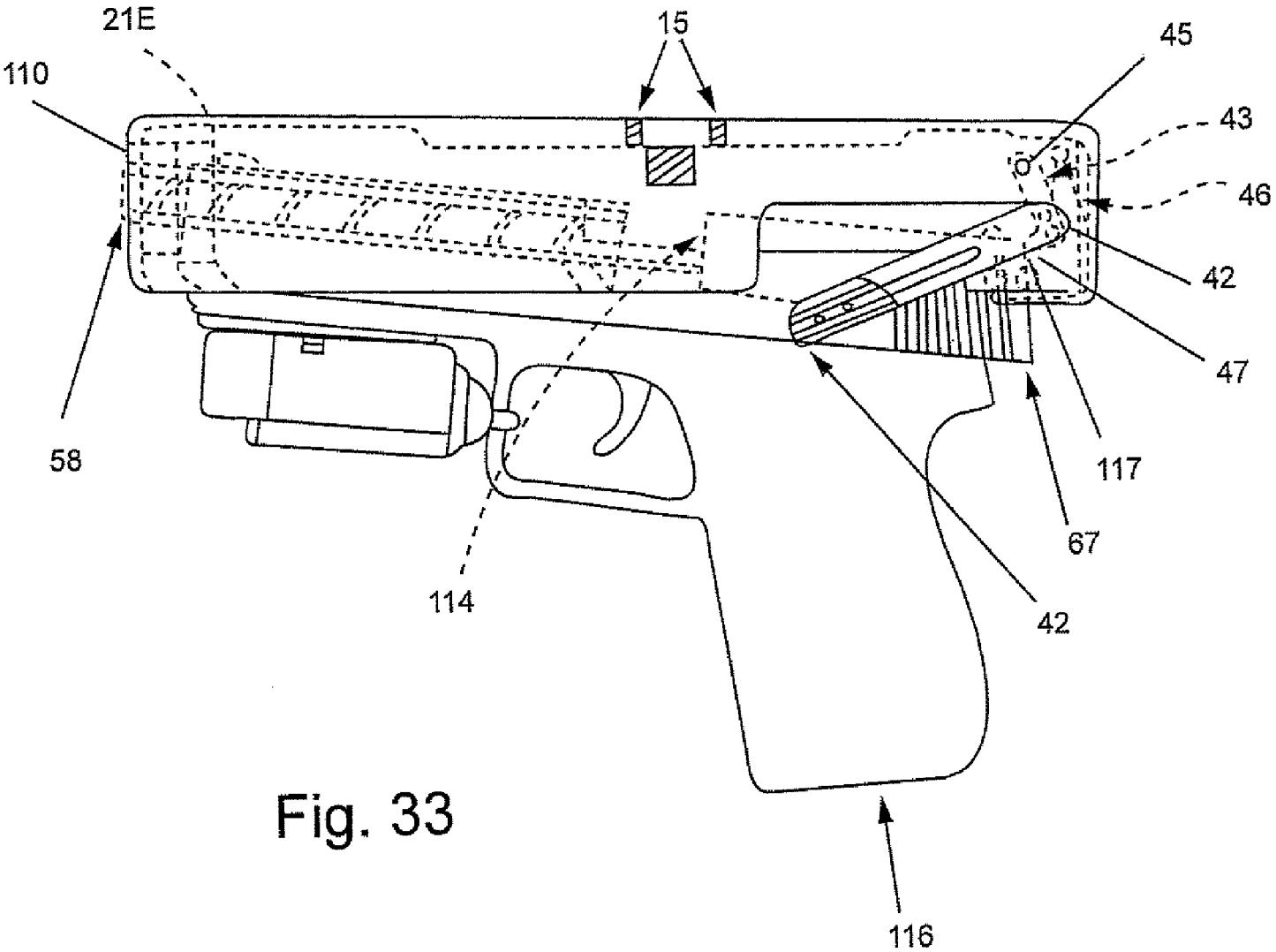
FIG. 33 is a view similar to the view of FIG. 32 with the pistol moved further into the holster of the invention.

In general, FIG. 33 shows an empty pistol with no magazine in the pistol's grip with the muzzle end of the barrel being inserted into the holster shroud with the muzzle end of the pistol's slide contacting the muzzle slide stop as the pistol is being pushed forward into the shroud, as discussed above in the discussion of FIG. 32. The forward movement of the receiver causes the slide to partially open as the muzzle of the barrel passes through its designated hole at the forward end of the slide shroud of the holster. At this point, the most rearward top of the pistol's slide is in contact with the protruding portion of the spring-loaded pivoting cam lock causing same to move backwards compressing the spring-loaded pivoting cam lock spring in order for the slide to come into proper alignment within the slide shroud. As the safety lever is bolted by screws, e.g. two screws shown in FIG. 33, to the spring-loaded pivoting cam lock, the safety lever is correspondingly moved from its horizontal locked position to its downward unlocked position. At the completion of insertion of the pistol in alignment with the slide within the holster shroud, the spring will unload its compression as the protruding portion of the spring-loaded pivoting cam lock enters the under-cut portion at the rear bottom of the now positioned slide. This moves the safety lever up, automatically locking the slide into the holster by the now locked position status of the spring-loaded pivoting cam lock.

Specifically, FIG. 33 shows the muzzle end 58 of the barrel protruding from the hole at the muzzle end 110 of the holster shroud as the pistol 24 is pushed into the holster shroud 21E by a rotational forward and down motion of the top forward portion 117 of the slide 66. The pistol 24 moving into the shroud comes into contact with the distal portion of the spring-loaded pivoting cam lock 47, which causes the spring-loaded pivoting cam lock 43 to backward rotate on the pivoting pin 45, compressing the spring 46 causing the lever 42 to index downward to open position. As the pistol 24 is placed further in the shroud 21E, the top forward portion 117 of the slide bears on the distal portion of the spring-loaded pivoting cam lock 47. As the pistol is further arced into the shroud, the distal portion of the spring-loaded pivoting cam lock 47 follows the configuration bearing on the top end of the slide until it springs forward into the indented mating configuration 67 between the slide and receiver. The mounting holes 15 are used for attaching the shroud to the adjustable hip plate mount 1, as previously discussed.

Figure 34:
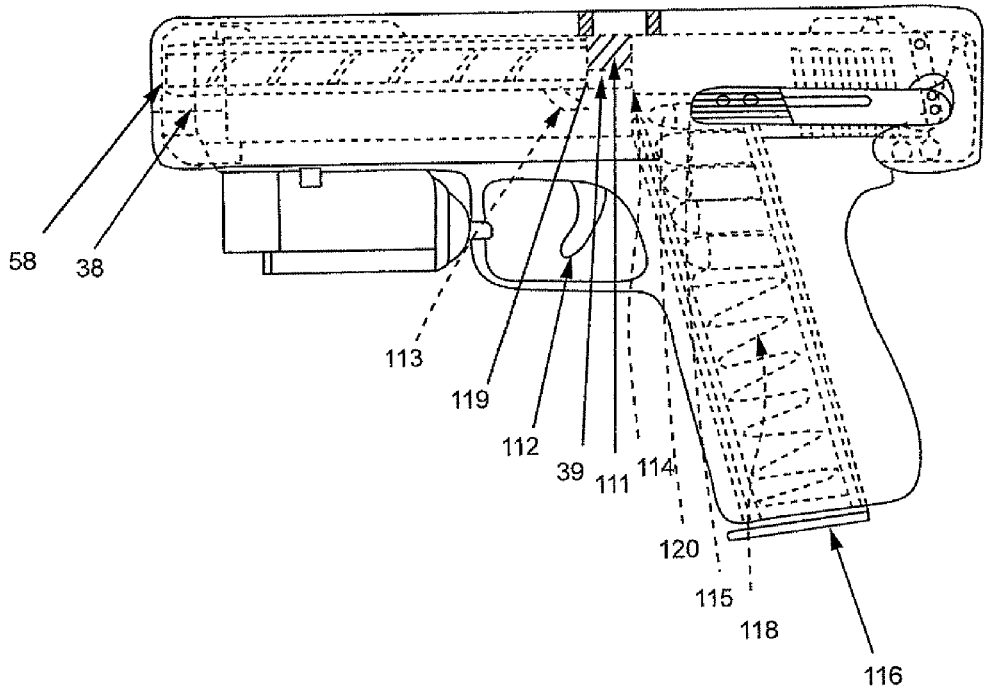
FIG. 34 is a view similar to the view of FIG. 32 with the pistol mounted in the holster and a clip in the handle of the pistol.

In general, FIG. 34, like FIG. 32, shows the pistol 24 after it has been placed in the shroud and after the officer has released the downward pressure on the pistol's grip, thereby allowing the pistol's receiver to be forced to the rear by the pistol's previously fully compressed recoil spring, as previously discussed. As the pistol's receiver moves to the rear, the shroud's top-mounted slide locking lug comes in contact with the top portion of the barrel, while at the same time, its protruding portion enters the barrel. The vertical and horizontal bearing of the shroud's top-mounted slide locking lug now locks the pistol automatically within the holster. The pistol is now incapable of being taken out of the holster shroud unless the previous action is repeated in reverse so as to disengage the lock-up of the pistol's chamber with the locking lug. This can only be done by pushing down on the pistol grip with sufficient force to clear the lug. FIG. 34 shows, as opposed to the previous FIGS. 32 and 33, a partially loaded magazine in the grip portion of the receiver. The top cartridge in the receiver is maintained under pressure of the spring of the magazine as its upward movement is restricted by the under-carriage of the slide. The pistol's trigger is in an inoperative status as the slide is partially open. It is noted that between FIG. 34 and FIG. 33, which show the unloaded pistol being placed into the holster, the cam locking element was engaged by the top of the slide as the slide pushes the cam locking element to the rear. This movement to the rear, forces the cam locking element spring to compress the pistol's slide. Entry of the pistol into perfect alignment with the holster shroud has caused the cam locking element to retract to its compressed point until the slide is in perfect alignment. At that point, the rounded end of the cam locking element enters the internal notch near the bottom of the slide. During this movement of the pistol entering the holster, as the spring compresses by the cam locking element being forced back by entry of the slide, the safety lever of the cam locking element is automatically positioned downward until the rounded surface of the lower portion of the cam locking element enters the internal notch of the rear of the slide. At this time, the spring of the cam locking element releases its tension and allows the cam locking lever to index into the internal underside of the slide. This allows the safety lever to automatically index parallel to the shroud in its locked position. The pistol cannot be removed from the holster unless the safety locking lever is pushed down and, at the same time, the pistol is pivoted to the rear of the holster freeing the locking lug and progressing to the status as shown in FIG. 34.

More particularly, FIG. 34 shows a partially loaded magazine 118 within the pistol's grip. With the slide maintained partially retracted with the presence of the locking lug boss 111 within the partially chamber 39 with the breech face 114 bearing against the boss 111, the protruding underside follower 115, is bearing on the upper most cartridge in the magazine 120 restricting its upward movement. The under-cut portion 119 of the barrel bears on the locking lug boss 111.

Figure 35:
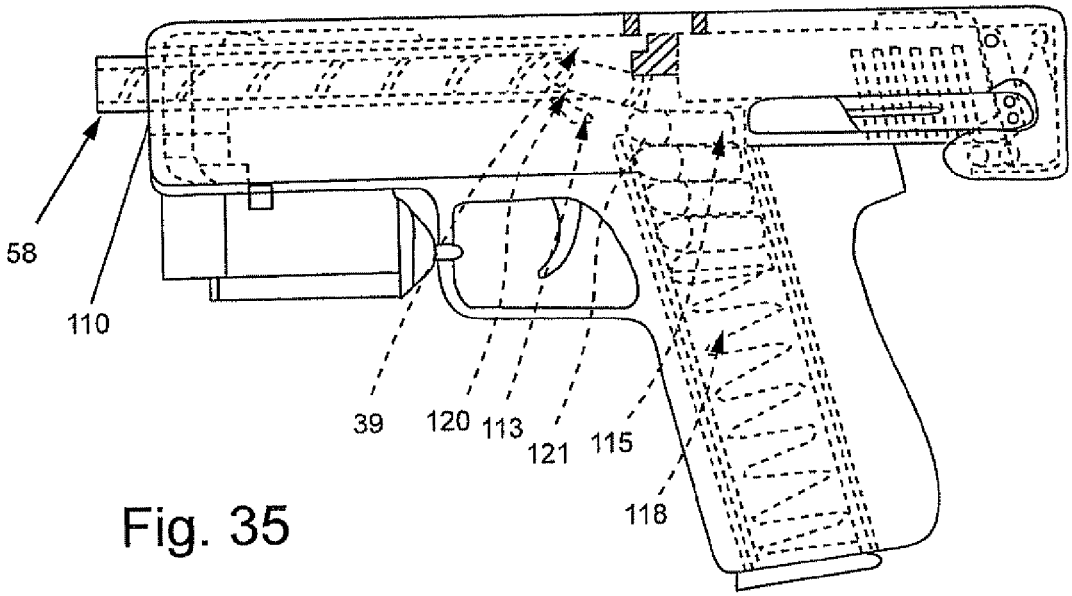
FIG. 35 is a view similar to the view of FIG. 32 with a cartridge moving into the chamber of the pistol.

In general, FIG. 35 shows a pistol being pushed to its fullest travel in a forward motion allowing the muzzle end of the barrel to pass through the muzzle end of barrel opening, which fully opens the chamber. With the chamber now fully opened and the slide maintained in the locked position relative to the full downward movement of the receiver, the heretofore constraining pressure of the underside portion of the slide relaxes the full pressure on the spring of the magazine sufficiently enough for the top round in the magazine to index upward on to the feed ramp of the barrel with the rear of round gliding on the bottom portion of the locking lug. At this point, with the pistol's receiver pushed down to its furthest point, the top round in the magazine is poised to enter the barrel, as when downward pressure on the receiver grip is relaxed causing the receiver to move to the rear relative to the static position of the slide closing during this action as is discussed below in regards to FIG. 56.

Specifically, FIG. 35 shows the pistol 24 pushed to its full downward motion exposing the barrel muzzle end 58 through an opening 110 allowing the chamber 39 to open fully. With the slide retracted to its fullest in relation to the downward movement of the receiver, the chamber 39 is at its maximum opening. In so doing, the protruding underside follower of the slide 115 is retracted from bearing on the cartridge, allowing the spring action of the magazine 118 to drive the first round 120 upward onto the feed ramp 113 beneath the locking lug boss 111 and into the barrel at the shown angle. The second round 121 is still maintained in a captured position by the slide follower 115, maintaining restriction on upward movement of the next round.

Figure 36:
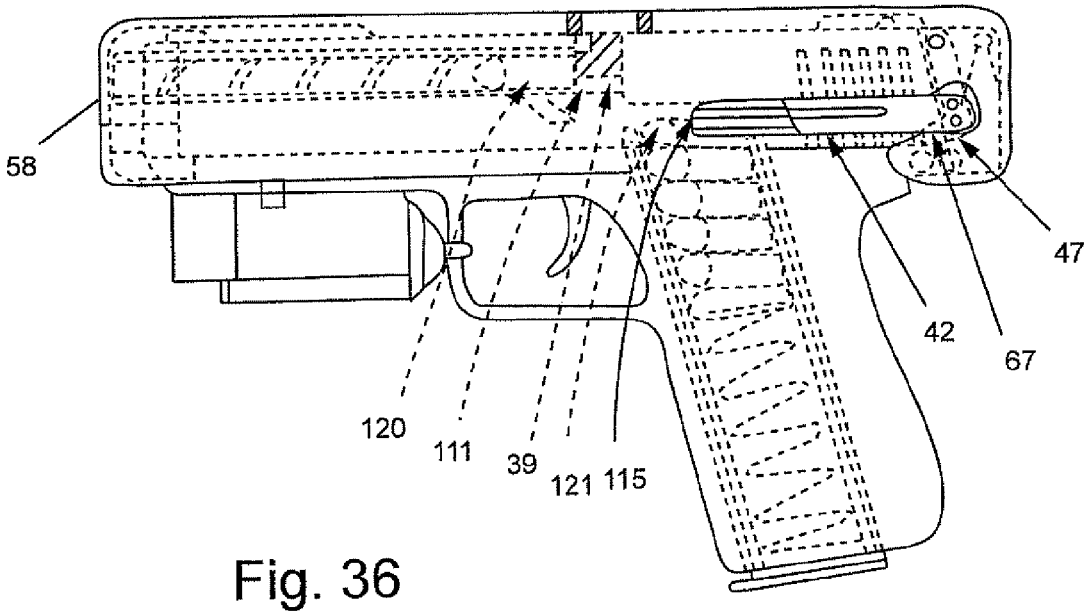
FIG. 36 is a view similar to the view of FIG. 32 with a cartridge in the chamber of the revolver.

In general, FIG. 36 shows the rearward movement of the receiver has resulted in the previously poised top round indexing up the feed ramp and into the barrel as the barrel follows the rearward action of the receiver (see FIG. 35). This action causes the top round to enter the barrel as the receiver closes the chamber into a partially opened non-fireable position. The pistol cannot be fired in this position, as not only is the chamber partially opened automatically disengaging the trigger, but also, the firing pin contained in the slide at the rear of the chamber cannot actuate because the trigger disconnect automatically neutralizes the firing pin from moving with the chamber partially opened. Additionally, any movement of the firing pin forward would not allow ignition of the cartridge, as the firing pin would strike the bearing surface of the slide locking lug, which not only locks the pistol in the holster rendering it un-fireable, but also acts as a positive buffer between the firing pin and the primer of the chambered round.

Specifically, FIG. 36 shows that with the movement of the pistol's receiver to the rear, the muzzle end of the barrel 58 has retracted into the shroud 21, and the partially opened receiver has retracted correspondingly backward within the pistols chamber 39. The first round 120 is thus pushed into battery by the reciprocating action of the slide to receiver motion, placing the locking lug boss 111 in line with the rear of the associated cartridge 120. The next round to be loaded 121 is still pressed into its position of the magazine, by the presence of the slide follower 115. The actuating safety lever 42 has moved to its locked position placing the distal position of the pivoting cam lock 47 into the indented mating configuration between slide and receiver 67 maintaining the slide partially opened and, thereby, the gun un-fireable.

As is appreciated by those skilled in the art, the invention is not limited to the materials used to make the holster of the invention. For example and not limiting thereto, materials that can be used in the practice of the invention include metals, plastics, and fiber re-enforced plastics.

As can be appreciated, the invention is not limited to the non-limited embodiments discussed herein and combination of the components discussed herein can be made without deviating from the spirit of the invention.

The invention claimed is:

1. A holster for a handgun comprising:

a shroud having a first end and an opposite second end, a wall between the first and second ends to provide the shroud with a cavity, the wall having a first edge and a second edge spaced from the first edge to define an elongated opening between the first and second ends, the opening providing access to the cavity to receive a portion of the handgun with a portion of the grip of the handgun extending outside the opening;

a first biasing member in the cavity at the first end of the shroud, the first biasing member when compressed applying a bias force toward the second end of the shroud;

a locking arrangement in the cavity at the second end of the shroud, wherein when the handgun is inserted in the cavity, the first biasing member applies a biasing force on a firing end of the handgun to bias an opposite end of the handgun into engagement with the locking arrangement to secure the handgun in the shroud;

wherein the locking arrangement comprises:

a cam lock having a first end pivotally mounted to the wall of the cavity adjacent the second end of the shroud with an open end of the cam lock facing the first end of the shroud;

an elongated lever having a first end and an opposite second end with the first end of the lever secured to the cam lock;

a second biasing member acting on the cam lock to bias a second end of the cam lock toward the first end of the shroud and move the lever to a first position, wherein moving the lever toward a second position moves the cam lock against the biasing action of the second biasing member to move the second end of the cam lock toward the second end of the shroud against the biasing action of the second biasing member.

2. The holster according to claim 1, wherein the wall of the cavity has three wall-sides with the wall-side having the first edge having a cut out adjacent the second end of the shroud;

wherein with the lever in the first position, the first and second ends of the lever are in the cutout of the shroud and with the lever in the second position, the second end of the lever is out of the cutout, and wherein the second biasing member is between the second end of the shroud and the cam lock.

3. The holster according to claim 2 further comprising:

a pair of holes in the shroud adjacent the second end of the shroud, one of the pair of holes in the wall-side having the first edge and the other one of the pair of holes in the wall-side having the second edge with centerline of the pair of holes intercepting path of the lever as it moves between the first and second positions, and a rigid elongated member in the pair of holes intercepting the path of the lever.

4. The holster according to claim 3, wherein the rigid elongated member has a headed end to engage outer surface portion of the shroud when the rigid elongated member is in the pair of holes and the other end of the rigid elongated member extends beyond the outer surface of the shroud and having a passageway to receive arms of a lock to secure the elongated member in the pair of holes.

5. The holster according to claim 3, wherein the rigid elongated member has a first end extending beyond the outer surface of the shroud and having a pull ring, and an opposite second end of the rigid elongated member extending beyond the outer surface of the shroud and having compressible tabs to detachably secure the rigid elongated member in the pair of holes.

6. The holster according to claim 3 further comprising:

a first shield guard detachably secured to one wall-side of the shroud and a second shield guard detachable secured to the opposite wall-side of the shroud, the first and second shield guards extending from their respective wall-side and spaced from one another;

a hole in each of the shield guards with the holes in the shield guard aligned with one another, and an elongated member extending from the hole in the first shield guard to the hole in the second shield guard.

7. The holster according to claim 1 further comprising a spring biased pin mounted on inner surface of the shroud between the first and second ends of the shroud and opposite the opening of the shroud, wherein with the spring in the compressed state an end of the pin extends beyond outer surface of the shroud and the pin is biased toward the opening of the shroud.

8. The holster according to claim 1, wherein the lever is a flat member having an elongated groove extending between the first end and the second end of the lever, a slide member moveable in the groove of the flat member, and fasteners extending through the groove into the slide member to secure the slide member at a predetermined position between the first and second ends of the lever.

9. The holster according to claim 1, wherein the lever is a flat member having a plurality of spaced holes extending between the first end and the second end of the lever, a finger engaging member, and a fastener extending through each of two holes of the plurality of holes in the slide member to secure the finger engaging member at a predetermined position between the first and second ends of the lever.

10. The holster according to claim 2, wherein the pair of holes is a first pair of holes and further comprising a second pair of holes between the first pair of holes and the second end of the shroud.

11. The holster according to claim 10 further comprising an elongated member having a pair of grooves, the elongated member slidably mounted in the second pair of holes to vary the distance between the grooves of the elongated member and adjacent the inner surface of the shroud.

12. The holster according to claim 10 further comprising an elongated member having a flat surface and an opposite rounded surface, the elongated member rotatably mounted in the second pair of holes to position the flat surface in facing relationship to the opening or the in facing relationship to the interior of the shroud.

13. The holster according to claim 1, wherein the shroud has a hole in the first end of the shroud to receive the muzzle end of a handgun.

14. The holster according to claim 13, wherein the handgun has an ejection chamber and further comprising a boss mounted on an inner surface of the wall facing the opening of the shroud and sized to fit into the ejection chamber.

15. The holster according to claim 1, wherein the handgun has a rotating cylinder with a plurality of spaced outer grooves;

wherein the wall of the cavity has three wall-sides;

the locking arrangement is a protrusion between the wall-sides having the edges defining the opening of the shroud, spaced from the third wall-side and extending from the inner surface of the second end of the shroud toward the first end of the shroud, and further comprising a pair of spaced bosses extending from the inner surface of the third wall-side toward the opening and sized to engage two of the grooves of the rotating cylinder.

16. The holster according to claim 1 further comprising a handgun mounted in the shroud with the firing end of the handgun at the first end of the shroud and the opposite end of the handgun at the second end of the shroud and the handle of the handgun extending out of the opening of the shroud.

* * * * *